US006873106B2

(12) United States Patent
Amemiya et al.

(10) Patent No.: US 6,873,106 B2
(45) Date of Patent: Mar. 29, 2005

(54) PLASMA DISPLAY PANEL THAT INHIBITS FALSE DISCHARGE

(75) Inventors: Kimio Amemiya, Yamanashi-ken (JP); Nobuhiko Saegusa, Yamanashi-ken (JP); Chiharu Koshio, Yamanashi-ken (JP); Hitoshi Taniguchi, Yamanashi-ken (JP)

(73) Assignees: Pioneer Corporation, Tokyo (JP); Shizuoka Pioneer Corporation, Shizuoka-ken (JP)

( * ) Notice: Subject to any disclaimer, the term of this patent is extended or adjusted under 35 U.S.C. 154(b) by 9 days.

(21) Appl. No.: 09/862,696

(22) Filed: May 23, 2001

(65) Prior Publication Data

US 2001/0050534 A1 Dec. 13, 2001

(30) Foreign Application Priority Data

| | | |
|---|---|---|
| Jun. 1, 2000 | (JP) | 2000-164863 |
| Jun. 1, 2000 | (JP) | 2000-164864 |
| Jul. 28, 2000 | (JP) | 2000-229081 |
| Jul. 28, 2000 | (JP) | 2000-229082 |
| Nov. 29, 2000 | (JP) | 2000-363050 |

(51) Int. Cl.[7] ..... H01J 17/49
(52) U.S. Cl. ..... 313/587; 313/582; 313/586
(58) Field of Search ..... 313/582–587, 313/484–486

(56) References Cited

U.S. PATENT DOCUMENTS

| | | | | | |
|---|---|---|---|---|---|
| 5,742,122 | A | * | 4/1998 | Amemiya et al. | 313/582 |
| 5,952,782 | A | * | 9/1999 | Nanto et al. | 313/584 |
| 6,008,582 | A | * | 12/1999 | Asano et al. | 313/582 |
| 6,057,643 | A | * | 5/2000 | Kurai | 313/582 |
| 6,066,923 | A | * | 5/2000 | Noborio et al. | 315/169.4 |
| 6,229,582 | B1 | * | 5/2001 | Van Slooten | 349/32 |
| 6,344,715 | B2 | * | 2/2002 | Tokunaga et al. | 315/169.4 |
| 6,423,248 | B1 | * | 7/2002 | Rao et al. | 252/301.4 R |
| 2001/0024088 | A1 | * | 9/2001 | Justel et al. | 313/587 |

FOREIGN PATENT DOCUMENTS

| | | | | |
|---|---|---|---|---|
| EP | 0 779 643 A2 | | 6/1997 | |
| EP | 1 132 938 A2 | | 9/2001 | |
| JP | 09263756 A | * | 10/1997 | C09K/11/08 |
| JP | 10-308176 | | 1/1998 | |
| JP | 10-208647 | | 8/1998 | |
| JP | 11-345572 | | 12/1999 | |
| JP | 2000-133148 | | 5/2000 | |
| WO | WO 0139239 A1 | * | 5/2001 | C09K/11/08 |

* cited by examiner

*Primary Examiner*—Nimeshkumar D. Patel
*Assistant Examiner*—German Colón
(74) *Attorney, Agent, or Firm*—Arent Fox PLLC

(57) ABSTRACT

A plasma display panel includes: a plurality of row electrode pairs (X, Y) provided on a front glass substrate (10); a protective layer (12) on the front glass substrate (10); and a plurality of column electrodes (D) provided in a back substrate (13) at intersections with the row electrode pairs (X, Y) to form discharge cells (C) in the discharge space (S). An ultraviolet region light emissive layer (17) having persistence characteristics allowing continuous emission of ultraviolet light as a result of excitation by ultraviolet rays having 0.1 msec or more of a wavelength is provided at a site facing each discharge cell (C) between the front glass substrate (10) and the back glass substrate (13).

37 Claims, 27 Drawing Sheets

V1—V1

V 1 – V 1

V 2 – V 2

W1−W1

W2−W2

WITH ULTRAVIOLET REGION LIGHT EMISSIVE LAYER

WITHOUT ULTRAVIOLET REGION LIGHT EMISSIVE LAYER

V 3 – V 3

W 4 – W 4

V4—V4

W5—W5

V5–V5

V6–V6

W6—W6

W7—W7

V7–V7

V8–V8

V9—V9

W9—W9

V10—V10

W10—W10

PLASMA DISPLAY PANEL THAT INHIBITS FALSE DISCHARGE

BACKGROUND OF THE INVENTION

1. Field of the Invention

The invention relates to a plasma display panel of a matrix display scheme.

2. Description of the Related Art

Recent years, a plasma display panel of a matrix display scheme (hereinafter referred to as "PDP") has been received attention as an oversized and slim display for color screen.

An AC type PDP is known as such display panels of the matrix display scheme.

The AC type PDP includes a plurality of row electrode pairs arranged on the inner face of a front substrate so that each forms a display line, and a plurality of column electrodes arranged on the inner face of a back substrate, opposing the front substrate with a discharge space between, in a direction perpendicular to the row electrode pairs. At each intersection of the row electrode pairs and the column electrodes, discharge cells form a matrix in cooperation with each other.

The row electrode pairs and the column electrodes are overlaid with dielectric layers at the respective surfaces facing the discharge space. Phosphor layers are provided on the column electrodes arranged on the inner face of the back substrate.

One of conventionally known methods of displaying a halftone on such a PDP is a so-call sub-field method in which a display period of one field is divided into N sub-fields in which light is emitted at intervals corresponding to the weight of each bit position of the N-bit display data.

In the sub-field method, each sub-field consists of a concurrent reset period Rc, an addressing period Wc and a sustain discharge period Ic as illustrated in FIG. 40.

In the concurrent reset period Rc, reset pulses RPx, RPy are concurrently applied between the row electrodes $X_{1-n}$ and $Y_{1-n}$ paired with each other to produce discharge in all the discharge cells in unison, thereby temporarily forming a predetermined amount of wall charge in each discharge cell.

In the addressing period Wc, scan pulses SP are sequentially applied to the row electrodes $Y_{1-n}$ each which is one of the row electrode pair, and display data pulses $DP_{1-n}$ corresponding to the display data in each display line are applied to the column electrodes $D_{1-m}$ to initiate a selective discharge (selective eraser discharge).

During this period, corresponding to the display data, all the discharge cells are grouped into the lighted cells in which eraser discharge is not caused to maintain the wall charge, and the non-lighted cells in which the eraser discharge is caused to erase the wall charge.

In the sustain light-emission period Ic, sustain pulses IPx, IPy are applied between the row electrodes $X_{1-n}$, $Y_{1-n}$ paired with each other at intervals corresponding to the weight of each sub-field, to thereby allow the sustain discharge to be repeatedly produced in only the lighted cells, having residual wall charge, at intervals in accordance with the intervals of application of the sustain pulses IPx, IPy.

The discharge space between the front substrate and the back substrate is filled with a Ne—Xe gas containing 5 vol % xenon Xe. The sustain discharge allows radiation of 147 nm-wavelength vacuum ultraviolet rays from xenon Xe.

The vacuum ultraviolet rays excite the phosphor layers provided on the back substrate and then visible light is generated, resulting in the image display on the PDP.

In the PDP as described above, although the reset discharge in the concurrent reset period Rc of the sub-field method generates priming particles (charged particles) in the discharge space of all the discharge cells, the priming particles decrease as time goes by. Hence, the priming particles decrease in the display lines (e.g. an $n^{th}$ display line which forms the final scan line) in which the time interval until the next selection is operated (the scan pulses SP are applied) after the concurrent reset is operated is much longer than in the other display lines.

For this reason, in such discharge cells having a less quantity of priming particles, the discharge delay time is extended or variations of the discharge delay time are increased. This causes the selective discharge operation in the addressing period Wc to be unstable and to have a tendency to produce a false discharge, resulting in a disadvantage of loss of quality of displayed images.

SUMMARY OF THE INVENTION

The present invention has been made to overcome the disadvantages associated with the conventional plasma display panel as described hereinbefore.

It is therefore an object of the present invention to provide a plasma display panel capable of preventing a false discharge to improve the quality of displayed images.

To attain the above object, a plasma display panel according to a first invention includes a front substrate and a back substrate on opposite sides of a discharge space; a plurality of row electrode pairs extending in a row direction and arranged in a column direction on the front substrate to form display lines; a protective dielectric layer provided on a face of the front substrate facing the discharge space; a plurality of column electrodes extending in the column direction and arranged in the row direction on the back substrate to form a unit light emitting area in the discharge space at each intersection with the row electrode pair; and a phosphor layer on a face of the back substrate facing the discharge space. Such plasma display panel features in that a priming particle generating member is provided at a site facing each unit light emitting area between the front substrate and the back substrate.

In the plasma display panel according to the first invention, reset pulses are concurrently applied between the row electrodes paired with each other during a concurrent reset period. By this application, discharge is produced in all the unit light emitting areas in unison to form a predetermined amount of wall charge in each unit light emitting area.

In the subsequent addressing period, scan pulses are sequentially applied to the row electrodes each of which is one of the row electrode pair, and display data pulses corresponding to the display data in each display line are applied to the column electrodes to initiate a selective discharge.

During this period, corresponding to the display data, all the discharge cells are grouped into the lighted cells in which eraser discharge is not initiated to maintain the wall charge, and the non-lighted cells in which the eraser discharge is initiated to erase the wall charge.

In the subsequent sustain light-emission period, sustain pulses are applied between the row electrodes paired with each other, to allow the sustain discharge to be produced in the lighted cells having residual wall charge, resulting in generation of an image.

In this relation, the priming particle generating member is disposed at a site facing each unit light emitting area situated between the front substrate and the back substrate. Such priming particle generating member is constructed by, for example, an ultraviolet region light emissive layer formed of an ultraviolet region light emitting phosphor or a secondary electron emissive layer formed of a material having a coefficient of secondary electron emission higher than that of dielectrics forming the protective dielectric layer. In the case where the priming particle generating member is constructed by the ultraviolet region light emissive layer, in the reset discharge when an image is generated, the ultraviolet region light emissive layer is excited by ultraviolet rays which is radiated from a discharge gas filled into the discharge space, and due to persistence characteristics of the ultraviolet region light emitting phosphor which forms the ultraviolet region light emissive layer, the ultraviolet region light emissive layer continues radiating ultraviolet light.

Then, the radiated ultraviolet light causes the protective dielectric layer to emit second electrons. Hence, during the subsequent addressing period, priming particles in the discharge space of the lighted cells are regenerated, resulting in inhibiting a reduction of the amount of priming particles in each lighted cell.

In the case where the priming particle generating member is constructed by the secondary electron emissive layer, in the reset discharge when an image is generated, priming particles such as secondary electrons, excitation particles and ions are emitted from the priming particle generating member into the discharge space of the unit light emitting areas. For this reason, even when dielectrics forming the protective dielectric layer has a low coefficient of secondary electron emission, the amount of priming particles emitted from the priming particle generating member into the discharge space is increased, resulting in ensuring a sufficient amount of priming particle in the addressing period.

According to the first invention as described above, the priming particle generating member ensures a sufficient amount of priming particles during the addressing period. This inhibits an increase of a discharge delay time and also producing of variations of the discharge delay time in the display line in which a time interval until the scan pulses are applied in the subsequent addressing period after the concurrent reset period increases. The inhibitions lead to prevention of a selective discharge operation in the addressing period from becoming unstable to cause a false discharge, resulting in generation of high quality images.

To attain the aforementioned object, a plasma display panel according to a second invention features, in addition to the configuration of the first invention, in that the priming particle generating member is made up of an ultraviolet region light emissive layer formed of an ultraviolet region light emitting phosphor having persistence characteristics allowing continuous radiation of ultraviolet light as a result of excitation by ultraviolet rays having a predetermined wavelength.

In the plasma display panel according to the second invention, in the reset discharge when an image is generated, the ultraviolet rays radiated from the discharge gas filled in the discharge space excite the ultraviolet region light emissive layer, whereupon the ultraviolet light is emitted from the ultraviolet region light emissive layer.

The above ultraviolet region light emissive layer continues radiating the ultraviolet light due to the persistence characteristics of the ultraviolet region light emitting phosphor forming the above ultraviolet region light emissive layer. The radiated ultraviolet light causes the protective dielectric layer to emit secondary electrons. Hence, priming particles in the discharge space of the lighted cells are regenerated during the subsequent addressing period to inhibit a reduction of the amount of priming particles in each lighted cell.

According to the second invention, therefore, even in the discharge lines in which a time interval until the scan pulses are applied in the subsequent addressing period after the concurrent reset period increases, an increase of the display delay time is inhibited and also producing variations of the display delay time is inhibited. In consequence, even when a scan pulse or a display data pulse has a small pulse width, a selective discharge operation in the addressing period is prevented from becoming unstable to cause a false discharge, resulting in generation of high quality images.

To attain the aforementioned object, a plasma display panel according to a third invention features, in addition to the configuration of the second invention, in that the ultraviolet region light emitting phosphor forming the ultraviolet region light emissive layer is a light emissive material having the persistence characteristics allowing radiation for 0.1 msec or more. Thus, due to regeneration of the priming particles during the subsequent addressing period after the concurrent reset period, inhibition of a reduction of the amount of priming particles in each lighted cell is achieved.

To attain the aforementioned object, a plasma display panel according to a fourth invention features, in addition to the configuration of the second invention, in that the ultraviolet region light emissive layer extends in the row direction at each site opposing the row electrode pairs, and faces toward the discharge space of the unit light emitting areas adjacent to each other in the column direction.

With the above design, ultraviolet light is radiated from a ultraviolet region light emissive layer to the interior of the unit light emitting area, or the lighted cell, adjacent to the ultraviolet region light emissive layer in the column direction. Secondary electrons emitted from the protective dielectric layer by the ultraviolet light cause the regeneration of the priming particles in the lighted cell, resulting in inhibition of a reduction of the amount of priming particles in the lighted cell.

To attain the aforementioned object, a plasma display panel according to a fifth invention features, in addition to the configuration of the second invention, in that the ultraviolet region light emissive layer extends in column direction at each site between the unit light emitting areas adjacent to each other in the row direction, and faces toward the discharge space of the unit light emitting areas adjacent to each other in the row direction.

With the above design, ultraviolet light is radiated from an ultraviolet region light emissive layer to the interior of the unit light emitting area, or the lighted cell, adjacent to the ultraviolet region light emissive layer in the row direction. Secondary electrons emitted from the protective dielectric layer by the ultraviolet light cause the regeneration of the priming particles in the lighted cell, resulting in inhibition of a reduction of the amount of priming particles in the lighted cell.

To attain the aforementioned object, a plasma display panel according to a sixth invention features, in addition to the configuration of the second invention, in that a light absorption layer is provided at each position opposing a non-lighting area between the unit light emitting areas adjacent to each other in the row direction or the column direction of the front substrate, and opposite the back substrate in relation to the ultraviolet region light emissive layer.

The above design prevents the reflection of ambient light incident through the front substrate to improve the contrast on the display screen.

To attain the aforementioned object, a plasma display panel according to a seventh invention features, in addition to the configuration of the second invention, in that a partition wall is provided between the front substrate and the back substrate and with transverse walls extending in the row direction and vertical walls extending in the column direction to partition the discharge space into the unit light emitting areas, and in that the ultraviolet region light emissive layer is provided between the front substrate and the transverse wall of the partition wall.

With the above design, ultraviolet light is radiated from an ultraviolet region light emissive layer into the unit light emitting area partitioned by the partition wall which is of a lighted cell adjacent to the ultraviolet region light emissive layer in the column direction. Then, secondary electrons emitted from the protective dielectric layer by the radiated ultraviolet light causes the regeneration of priming particles in the lighted cell, resulting in inhibiting a reduction of the amount of priming particles in the lighted cell.

To attain the aforementioned object, a plasma display panel according to an eighth invention features, in addition to the configuration of the second invention, in that a partition wall is provided between the front substrate and the back substrate and with transverse walls extending in the row direction and vertical walls extending in the column direction to partition the discharge space into the unit light emitting areas, and in that the ultraviolet region light emissive layer is provided between the front substrate and the vertical wall of the partition wall.

With the above design, ultraviolet light is radiated from an ultraviolet region light emissive layer into the unit light emitting area partitioned by the partition wall which is of a lighted cell adjacent to the ultraviolet region light emissive layer in the row direction. Then, secondary electrons emitted from the protective dielectric layer by the radiated ultraviolet light causes the regeneration of priming particles in the lighted cell, resulting in inhibiting a reduction of the amount of priming particles in the lighted cell.

To attain the aforementioned object, a plasma display panel according to a ninth invention features, in addition to the configuration of the second invention, in that a stripe-patterned partition wall is disposed between the front substrate and the back substrate and extends in the column direction to partition the discharge space into the unit light emitting areas aligned in the column direction; in that a row electrode of each of the row electrode pair includes a main body extending in the row direction and a protruding portion protruding from the main body in the column direction in each unit light emitting area; and in that the ultraviolet region light emissive layer extends in the row direction at each position opposing the main bodies of the row electrodes.

With the above design, ultraviolet light is radiated from an ultraviolet region light emissive layer to the interior of the unit light emitting area, or the lighted cell, adjacent to the ultraviolet region light emissive layer in the column direction. Then, secondary electrons emitted from the protective dielectric layer by the ultraviolet light cause the regeneration of the priming particles in a lighted cell, resulting in inhibition of a reduction of the amount of priming particles in the lighted cell. In addition, each row electrode of each row electrode pair is composed of the main body extending in the row direction and the protruding portions each protruding from the main body in the column direction in each unit light emitting area. Since a discharge is caused at the protruding portions, the occurrence of interference between discharges in the adjacent unit light emitting areas in the column direction is inhibited.

To attain the aforementioned object, a plasma display panel according to a tenth invention features, in addition to the configuration of the first invention, in that the priming particle generating member is made up of a visible region light emissive layer formed of a visible region light emitting phosphor having persistence characteristics allowing continuous radiation of ultraviolet light as a result of excitation ultraviolet rays having a predetermined wavelength.

In the plasma display panel according to the tenth invention, in the reset discharge when an image is generated, the ultraviolet rays radiated from the discharge gas filled into the discharge space excite the visible region light emissive layer, whereupon the ultraviolet light is emitted from the visible region light emissive layer.

The visible region light emissive layer continues radiating the ultraviolet light due to the persistence characteristics of the visible region light emitting phosphor forming the visible region light emissive layer. The radiated ultraviolet light causes the protective dielectric layer to emit secondary electrons. For this reason, priming particles are regenerated in the discharge space of the lighted cell during the subsequent addressing period, resulting in inhibiting a reduction of the amount of priming particles in each lighted cell.

According to the tenth invention, in consequence, even in the display line in which a time interval until the scan pulses are applied in the subsequent addressing period after the concurrent reset period increases, an increase of a discharge delay time and also producing of variations of the discharge delay time are inhibited. Hence, even when a scan pulse or a display data pulse has a small pulse width, a selective discharge operation in the addressing period is prevented from becoming unstable to cause a false discharge, resulting in generation of high quality images.

To attain the aforementioned object, a plasma display panel according to an eleventh invention features, in addition to the configuration of the first invention, in that the priming particle generating member is made up of a secondary electron emissive layer formed of a material having a coefficient of secondary electron emission higher than that of dielectrics forming the protective dielectric layer.

According to the plasma display panel of the eleventh invention, in the reset discharge when an image is generated, the visible light radiated from the phosphor layer provided in each unit light emitting area excites the material having a high coefficient of secondary electron emission (a small work function) and forming the secondary electron emissive layer, whereupon secondary electrons are emitted from the secondary electron emissive layer into the discharge space of the unit light emitting area. For this reason, even when the dielectrics forming the protective dielectric layer has a low coefficient of secondary electron emission, provision of only the secondary electron emissive layer increases the amount of secondary electrons emitted into the discharge space, resulting in ensuring a sufficient amount of priming particles during the addressing period.

To attain the aforementioned object, a plasma display panel according to a twelfth invention features, in addition to the configuration of the eleventh invention, in that the phosphor layer contains the material, having a coefficient of secondary electron emission higher than that of the dielectrics forming the protective dielectric layer, to be formed in combination with the secondary electron emissive layer.

With this design, in the reset discharge when the image is generated and on the phosphor layer provided in each unit light emitting area, visible light radiated from the phosphor material forming the phosphor layer excites the material having a high coefficient of secondary electron emission and contained in the phosphor layer, whereupon secondary electrons are emitted into the discharge space of the unit light emitting area. This results in ensuring a sufficient amount of priming particles during the addressing period.

To attain the aforementioned object, a plasma display panel according to a thirteenth invention features, in addition to the configuration of the eleventh invention, in that a partition wall is provided between the front substrate and the back substrate for partitioning the discharge space into the unit light emitting areas, and in that the secondary electron emissive layer is provided on a side wall-face of the partition wall.

With this design, from a secondary electron emissive layer provided on the side wall-face of the partition wall, secondary electrons are emitted into the discharge space of a unit light emitting area which is partitioned by the partition wall and is adjacent to the secondary electron emissive layer in the column direction or the row direction. This results in ensuring a sufficient amount of priming particles in the above unit light emitting area.

To attain the aforementioned object, a plasma display panel according to a fourteenth invention features, in addition to the configuration of the eleventh invention, in that a partition wall is provided between the front substrate and the back substrate for partitioning the discharge space into the unit light emitting areas, and contains the material having a coefficient of secondary electron emission higher than that of the dielectrics forming the protective dielectric layer to be formed in combination with the secondary electron emissive layer.

With this design, from a secondary electron emissive layer combined with a partition wall, secondary electrons are emitted into the discharge space of a unit light emitting area which is partitioned by the partition wall and is adjacent to the secondary electron emissive layer in the column direction or the row direction. This results in ensuring a sufficient amount of priming particles in the above unit light emitting area.

To attain the aforementioned object, a plasma display panel according to a fifteenth invention features, in addition to the configuration of the eleventh invention, in that the secondary electron emissive layer is placed between the back substrate and the phosphor layer.

With this design, secondary electrons are emitted from the secondary electron emissive layer, situated between the front substrate and the phosphor layer, into the corresponding unit light emitting area.

To attain the aforementioned object, a plasma display panel according to a sixteenth invention features, in addition to the configuration of the eleventh invention, in that a dielectric layer overlays column electrodes between the back substrate and the phosphor layer, and contains the material, having a coefficient of secondary electron emission higher than that of the dielectrics forming the protective dielectric layer, to be formed in combination with the secondary electron emissive layer.

With this design, secondary electrons are emitted from the secondary electron emissive layer, which is combined with the dielectric layer, into the corresponding unit light emitting area.

To attain the aforementioned object, a plasma display panel according to a seventeenth invention features, in addition to the configuration of the first invention, in that the priming particle generating member includes a secondary electron emissive layer formed of a material having a coefficient of secondary electron emission higher than that of dielectrics forming the protective dielectric layer and, an ultraviolet region light emissive layer formed of an ultraviolet region light emitting phosphor having persistence characteristics allowing continuous radiation of ultraviolet light as a result of excitation by ultraviolet rays having a predetermined wavelength or a visible region light emissive layer formed of a visible region light emitting phosphor having persistence characteristics allowing continuous radiation of visible light as a result of excitation by ultraviolet rays having a predetermined wavelength.

According to the plasma display panel of the seventeenth invention, in the reset discharge when an image is generated, ultraviolet rays radiated from the discharge gas filled into the discharge space excite an ultraviolet region light emissive layer or a visible region light emissive layer, whereupon ultraviolet light or visible light is radiated.

The ultraviolet region light emissive layer or the visible region light emissive layer continues radiating the ultraviolet light or the visible light due to the persistence characteristics of the ultraviolet region light emitting phosphor forming the ultraviolet region light emissive layer or of the visible region light emitting phosphor forming the visible region light emissive layer. Hence, during the addressing period, secondary electrons are emitted from the protective dielectric layer or the secondary electron emissive layer by the ultraviolet light or the visible light. This inhibits a reduction of the amount of priming particles in each unit light emitting area, which leads to inhibition of an increase of the discharge delay time and producing of variations of the discharge delay time.

To attain the aforementioned object, a plasma display panel according to an eighteenth invention features, in addition to the configuration of the seventeenth invention, in that the ultraviolet region light emissive layer or the visible region light emissive layer contains the material having a coefficient of secondary electron emission higher than that of the dielectrics forming the protective dielectric layer, to be formed in combination with the secondary electron emissive layer.

With this design, second electrons are emitted from the secondary electron emissive layer, combined with the ultraviolet region light emissive layer or the visible region light emissive layer, into the corresponding unit light emitting area.

To attain the aforementioned object, a plasma display panel according to a nineteenth invention features, in addition to the configuration of the seventeenth invention, in that the phosphor layer contains the ultraviolet region light emitting phosphor to be formed in combination with the ultraviolet region light emissive layer.

With this design, due to the persistence characteristic of the ultraviolet region light emitting phosphor which forms a ultraviolet region light emissive layer, ultraviolet light is continuously radiated from the ultraviolet region light emissive layer, formed in combination with the phosphor layer, into the discharge space of the corresponding unit light emitting area.

To attain the aforementioned object, a plasma display panel according to a twentieth invention features, in addition to the configuration of the seventeenth invention, in that the phosphor layer contains the ultraviolet region light emitting phosphor and the material having a coefficient of secondary electron emission higher than that of the dielectrics forming the protective dielectric layer to be formed in combination with the ultraviolet region light emissive layer and the secondary electron emissive layer.

With this design, in the reset discharge when an image is generated, on a phosphor layer provided in each unit light emitting area, visible light radiated from the phosphor material forming the phosphor layer excites a material, which has a high coefficient of secondary electron emission and is contained in the phosphor layer, to cause the material to emit secondary electrons into the discharge space of the unit light emitting area. In addition, the ultraviolet region light emissive layer formed in combination with the above phosphor layer continues radiating ultraviolet light due to the persistence characteristic of an ultraviolet region light emitting phosphor forming the ultraviolet region light emissive layer. As a result, the secondary electrons are continuously emitted from the secondary electron emissive layer formed in combination with the phosphor layer during the addressing period.

To attain the aforementioned object, a plasma display panel according to a twenty-first invention features, in addition to the configuration of the seventeenth invention to the twentieth invention, in that the ultraviolet region light emitting phosphor forming the ultraviolet region light emissive layer or the visible region light emitting phosphor forming the visible region light emissive layer is a light emissive material having persistence characteristics allowing radiation for 0.1 msec or more.

With this design, priming particles are regenerated during the addressing period following the concurrent reset period, which allows inhibition of a reduction of the amount of priming particles in each unit light emitting area.

To attain the aforementioned object, a plasma display panel according to a twenty-second invention features, in addition to the configuration of the first invention, in that the priming particle generating member extends in the row direction at a site opposing the row electrode pairs, and faces toward the discharge space of the adjacent unit light emitting areas in the column direction.

With this design, since priming particles are emitted from a priming particle generating member into the discharge space of a unit light emitting area adjacent to the priming particle generating member in the column direction, a sufficient amount of priming particles is ensured in the unit light emitting area.

To attain the aforementioned object, a plasma display panel according to a twenty-third invention features, in addition to the configuration of the first invention, in that the priming particle generating member extends in the column direction at a site between the unit light emitting areas adjacent to each other in the row direction, and faces toward the discharge space of the adjacent unit light emitting areas in the row direction.

With this design, since priming particles are emitted from a priming particle generating member into the discharge space of a unit light emitting area adjacent to the priming particle generating member in the row direction, a sufficient amount of priming particles is ensured in the unit light emitting area.

To attain the aforementioned object, a plasma display panel according to a twenty-fourth invention features, in addition to the configuration of the first invention, in that a partition wall is provided between the front substrate and the back substrate and with transverse walls extending in the row direction and vertical walls extending in the column direction to partition the discharge space into the unit light emitting areas, and in that the priming particle generating member is provided between the front substrate and the transverse wall of the partition wall.

With this design, since priming particles are emitted from a priming particle generating member into the discharge space of a unit light emitting area which is partitioned by a partition wall and adjacent to the priming particle generating member in the column direction, a sufficient amount of priming particles is ensured in the unit light emitting area.

To attain the aforementioned object, a plasma display panel according to a twenty-fifth invention features, in addition to the configuration of the first invention, in that a partition wall is provided between the front substrate and the back substrate and with transverse walls extending in the row direction and vertical walls extending in the column direction to partition the discharge space into the unit light emitting areas, and in that the priming particle generating member is provided between the front substrate and the vertical wall of the partition wall.

With this design, since priming particles are emitted from a priming particle generating member into the discharge space of a unit light emitting area which is partitioned by a partition wall and adjacent to the priming particle generating member in the row direction, a sufficient amount of priming particles is ensured in the unit light emitting area.

To attain the aforementioned object, a plasma display panel according to a twenty-sixth invention features, in addition to the configuration of the first invention, in that a stripe-patterned partition wall is disposed between the front substrate and the back substrate and extends in the column direction for partitioning the discharge space into the unit light emitting areas aligned in the row direction, and in that the priming particle generating member extends in the row direction at a site opposing main bodies of row electrodes of the row electrode pairs.

With this design, since priming particles are emitted from a priming particle generating member into the discharge space of a unit light emitting area adjacent to the priming particle generating member in the column direction, a sufficient amount of priming particles is ensured in the unit light emitting area.

To attain the aforementioned object, a plasma display panel according to a twenty-seventh invention features, in addition to the configuration of the seventeenth invention, in that a light absorption layer is provided at a position opposing a non-lighting area between the unit light emitting areas adjacent to each other in the row direction or the column direction of the front substrate, and opposite the back substrate in relation to the ultraviolet region light emissive layer or the visible region light emissive layer.

This design prevents the reflection of ambient light, incident through the front substrate, on the non-lighting area in the screen, to improve the contrast on the display screen.

To attain the aforementioned object, a plasma display panel according to a twenty-eighth invention includes a front substrate; a back substrate; a plurality of row electrode pairs arranged in a column direction and extending in a row direction to form display lines on a back face of the front substrate; a dielectric layer overlaying the row electrode pairs on the back face of the front substrate; a protective dielectric layer overlaying the dielectric layer on the back face of the front substrate; and a plurality of column electrodes arranged in the row direction on a face of the back substrate opposing the front substrate with a discharge space between, and extending in the column direction to form unit light emitting areas in the discharge space at each intersection of the row electrode pairs and the column electrodes. Such plasma display panel features in that a priming particle generating member is provided in contact with the discharge space between the adjacent unit light emitting areas in the column direction or the row direction.

According to the twenty-eighth invention, by providing the priming particle generating member, the amount of priming particles during the addressing period following the concurrent reset period is sufficiently ensured. This prevents occurrence of a false discharge and achieves improvement of the quality of the displayed images.

To attain the aforementioned object, a plasma display panel according to a twenty-ninth invention features, in addition to the configuration of the twenty-eighth invention, in that the priming particle generating member is formed of an ultraviolet region light emissive material or a visible region light emissive material having persistence characteristics allowing emission for 0.1 msec or more.

With this design, since the generation of the priming particles is continued during the addressing period following the concurrent reset period, the prevention of occurrence of a false discharge and the improvement of the quality of the displayed images are achieved.

To attain the aforementioned object, a plasma display panel according to a thirtieth invention features, in addition to the configuration of the twenty-ninth invention, in that the priming particle generating member includes a material having a work function smaller than that of dielectrics forming the protective dielectric layer.

With this design, ultraviolet light or visible light radiated by exciting the priming particle generating member excites the material which has a work function smaller than that of the dielectrics forming the protective dielectric layer and is contained in the priming particle generating member with the protective dielectric layer, whereupon the priming particles are radiated. For this reason, the amount of priming particles in the addressing period is sufficiently ensured.

To attain the aforementioned object, a plasma display panel according to a thirty-first invention features, in addition to the configuration of the twenty-eighth invention, in that a partition wall is provided between the front substrate and the back substrate and with vertical walls extending in the column direction and transverse walls extending in the row direction to define the discharge space into the unit light emitting areas in the row direction and in the column direction, the transverse wall between the unit light emitting areas to each other in the column direction being divided; in that an interstice extending in parallel to the row direction is provided between the divided transverse walls to space the divided transverse walls from each other; in that a communication element provided for communication between the interior of the interstice and the interior of the discharge spaces of the unit light emitting areas adjacent to the interstice in the column direction; and in that the priming particle generating member is placed in the interstice.

In the plasma display panel according to the thirty-first invention, the partition wall having the vertical walls extending in the column direction and the transverse walls extending in the row direction defines the discharge space between the front substrate and the back substrate into the unit light emitting areas.

The transverse wall situated between the unit light emitting areas aligned along the adjacent rows is divided and spaced by the interstice extending parallel to the row direction. The interior of the interstice provided between the divided transverse walls communicates through the communication element with the interior of the discharge space of the adjacent unit light emitting areas in the column direction. The priming particle generating member is disposed in the interstice and is in contact with the interior of the discharge space of the unit light emitting area via the communication element.

According to the thirty-first invention, therefore, even when the transverse wall of the partition wall blocks the adjacent unit light emitting areas in the column direction from each other, priming particles generated by a discharge in the interstice between the divided transverse walls which is associated with a discharge initiated in the unit light emitting area, spread through the communication element into the adjacent unit light emitting areas in the column direction to induce discharges, resulting in ensuring the priming effect between the adjacent unit light emitting areas in the column direction.

Moreover, when the reset discharge is caused in the reset operation, vacuum ultraviolet rays radiated from xenon included in the discharge gas filled into the discharge space excite the priming particle generating layer provided in the interstice between the divided transverse wall. Then, ultraviolet light or visible light radiated from the excited priming particle generating layer excite the protective dielectric layer to cause it to emit priming particles. For this reason, a sufficient amount of priming particles is ensured in the addressing period, resulting in preventing occurrence of a false discharge and improving the quality of the display images.

To attain the aforementioned object, a plasma display panel according to a thirty-second invention features, in addition to the configuration of the thirty-first invention, in that an additional portion is provided at a portion of the dielectric layer, opposing the transverse wall of the partition wall and the interstice, and protrudes toward the transverse wall. This design prevents occurrence of a false discharge between the adjacent unit light emitting areas in the column direction.

To attain the aforementioned object, a plasma display panel according to a thirty-third invention features, in addition to the configuration of the thirty-second invention, in that the communication element is provided in the additional portion. Through the communication element, the priming particle generating layer provided in the interstice between the divided transverse walls is in contact with the discharge space in the unit light emitting area to be excited by the vacuum ultraviolet rays radiated in the reset discharge.

To attain the aforementioned object, a plasma display panel according to a thirty-fourth invention features, in addition to the configuration of the thirty-first invention, in that the communication element is provided in the transverse wall of the partition wall. Through the communication element, the priming particle generating layer provided in the interstice between the divided transverse walls is in contact with the discharge space in the unit light emitting area to be excited by the vacuum ultraviolet rays radiated in the reset discharge.

To attain the aforementioned object, a plasma display panel according to a thirty-fifth invention features, in addition to the configuration of the twenty-eighth invention, in that a light absorption layer is provided at a portion of the dielectric layer opposing the interstice.

This design prevents the reflection of ambient light on the non-display line to improve contrast. In addition, even when a discharge for the priming is caused between the column electrode and the row electrode in the interstice, the resulting light may not adversely affect the contrast on the image.

To attain the aforementioned object, a plasma display panel according to a thirty-sixth invention features, in addition to the configuration of the thirty-first invention, in that the transverse walls of the partition wall on the front substrate side have respectively parts higher in height than the vertical wall, to form a groove between the adjacent higher parts for constructing the communication element. With the groove, the interior of the interstice between the divided transverse walls communicates the interior of the discharge space of the unit light emitting area.

To attain the aforementioned object, a plasma display panel according to a thirty-seventh invention features, in addition to the configuration of the thirty-sixth invention, in that the priming particle generating member is disposed on at least a portion in contact with the groove and of the higher part of the transverse wall having a higher height than that of the vertical wall.

With this design, in the reset discharge when an image is generated, the priming particle generating member disposed on the higher part of the transverse wall situated at a higher level than the vertical wall is excited by vacuum ultraviolet region rays radiated from xenon included in the discharge gas to radiate ultraviolet light or visible light. The radiated ultraviolet light or visible light excites the protective dielectric layer to cause it to emit priming particles.

To attain the aforementioned object, a plasma display panel according to a thirty-eighth invention features, in addition to the configuration of the thirty-seventh invention, in that the priming particle generating member is formed of an ultraviolet region light emissive material or a visible region light emissive material having persistence characteristics allowing emission for 0.1 msec or more. With this design, the priming particles are generated without interruption during the addressing period following the concurrent reset period. Hence, prevention of false discharges and improvement of the quality of display images are achieved.

To attain the aforementioned object, a plasma display panel according to a thirty-ninth invention features, in addition to the configuration of the thirty-eighth invention, in that the priming particle generating member includes a material having a work function smaller than that of dielectrics forming the protective dielectric layer.

With this design, ultraviolet light or visible light radiated by exciting the priming particle generating member excites the material, which has a work function smaller than that of the dielectrics forming the protective dielectric layer and is contained in the protective dielectric layer and the priming particle generating member, to cause the material to emit the priming particles. This results in ensuring a sufficient amount of priming particles in the addressing period.

To attain the aforementioned object, a plasma display panel according to a fortieth invention features, in addition to the configuration of the twenty-eighth invention, in that an additional portion is provided at a portion of the dielectric layer opposing the border between the unit light emitting areas adjacent to each other in the column direction, and juts toward the interior of the discharge space, and in that the priming particle generating member is disposed on a portion of the additional portion facing the discharge space.

With the additional portion, occurrence of a false discharge between the adjacent unit light emitting areas in the column direction is prevented. In addition, the priming particle generating member disposed on the additional portion is excited by the vacuum ultraviolet rays radiated from xenon included in the discharge gas in the reset discharge in the reset operation. Then the ultraviolet light or the visible light radiated from the excited priming particle generating member excites the protective dielectric layer to cause it to emit priming particles.

To attain the aforementioned object, a plasma display panel according to a forty-first invention features, in addition to the configuration of the fortieth invention, in that a light absorption layer is provided at a portion of the dielectric layer opposing the priming particle generating member. With this design, the reflection of ambient light on the non-display line is prevented to achieve the improvement of contrast.

To attain the aforementioned object, a plasma display panel according to a forty-second invention features, in addition to the configuration of the twenty-eighth invention, in that a partition wall is disposed between the front substrate and the back substrate, and defines the border between the unit light emitting areas adjacent to each other at least in the row direction, and in that the priming particle generating member is placed on a front face of the partition wall opposing the front substrate and faces the discharge space.

With the partition wall, occurrence of a false discharge between the adjacent unit light emitting areas in the row direction is prevented. In addition, the priming particle generating member disposed on the partition wall is excited by vacuum ultraviolet rays radiated from xenon included in the discharge gas in the reset discharge in the reset operation. Then the ultraviolet light or the visible light radiated from the excited priming particle generating member excites the protective dielectric layer to cause it to emit priming particles.

To attain the aforementioned object, a plasma display panel according to a forty-third invention features, in addition to the configuration of the fortieth invention, in that the priming particle generating member is formed of an ultraviolet region light emissive material or a visible region light emissive material having persistence characteristics allowing emission for 0.1 msec or more. With this design, generating of the priming particles are continued during the addressing period following the concurrent reset period. Hence, prevention of false discharges and improvement of the quality of display images are achieved.

To attain the aforementioned object, a plasma display panel according to a forty-fourth invention features, in addition to the configuration of the forty-third invention, in that the priming particle generating member includes a material having a work function smaller than that of dielectrics forming the protective dielectric layer.

With this design, the ultraviolet light or the visible light radiated from the excited priming particle generating member excites the material which has a work function smaller than that of the dielectrics forming the protective dielectric layer and is contained in the protective dielectric layer and the priming particle generating member, to cause the material to emit priming particles. Hence, a sufficient amount of priming particles is ensured in the addressing period.

To attain the aforementioned object, a plasma display panel according to a forty-fifth invention features, in addition to the configuration of the thirty-first invention, in that the transverse walls of the partition wall on the front substrate side have respectively higher parts in height than that of the vertical wall, to form a groove between the adjacent higher parts, and said priming particle generating member is disposed in the groove. A sufficient amount of priming particles in the addressing period is ensured because of the priming particles generated by the priming particle generating member disposed in the groove.

To attain the aforementioned object, a plasma display panel according to a forty-sixth invention features, in addition to the configuration of the forty-fifth invention, in that the priming particle generating member is formed of an ultraviolet region light emissive material or a visible region light emissive material having persistence characteristics allowing emission for 0.1 msec or more.

With this design, the priming particles are generated without interruption during the addressing period following the concurrent reset period. Hence, prevention of false discharges and improvement of the quality of display images are achieved.

To attain the aforementioned object, a plasma display panel according to a forty-seventh invention features, in addition to the configuration of the forty-sixth invention, in that the priming particle generating member includes a material having a work function smaller than that of dielectrics forming the protective dielectric layer.

With this design, the ultraviolet light or the visible light radiated from the excited priming particle generating member excites the material which has a work function smaller than that of the dielectrics forming the protective dielectric layer and is contained in the protective dielectric layer and the priming particle generating member, to cause the material to emit priming particles. Hence, a sufficient amount of priming particles is ensured in the addressing period.

To attain the aforementioned object, a plasma display panel according to a forty-eighth invention features, in addition to the configuration of the twenty-eighth invention, in that the discharge space is filled with a discharge gas including a mixed inert gas containing 10% or more of a xenon gas.

According to the plasma display panel of the forty-eighth invention, an increased of delay time of the selective discharge which is caused by an increase of partial pressure of the xenon gas is inhibited by providing the priming particle generating member, while the partial pressure of the xenon gas is set to exceed 10%. As a result, due to an increase of the amount of vacuum ultraviolet rays radiated from the xenon, an increase in emission efficiency is achieved.

To attain the aforementioned object, a plasma display panel according to a forty-ninth invention features, in addition to the configuration of the twenty-ninth, thirty-eighth, forty-third or forty-sixth invention, in that the priming particle generating member includes a material having a work function of 4.2 eV or less.

According to the plasma display panel of the forty-ninth invention, the priming effect is further exerted by providing the priming particle generating member. In consequence, a delay of the selective discharge and degradation in discharge probability in relation to a lapse of suspend time from the reset discharge are prevented.

To attain the aforementioned object, a plasma display panel according to a fiftieth invention features, in addition to the configuration of the forty-second invention, in that the priming particle generating member is formed of an ultraviolet region light emissive material or a visible region light emissive material having persistence characteristics allowing emission for 0.1 msec or more. With this design, generating of the priming particles are continued during the addressing period following the concurrent reset period. Hence, prevention of false discharges and improvement of the quality of display images are achieved.

To attain the aforementioned object, a plasma display panel according to a fiftieth-first invention features, in addition to the configuration of the fiftieth invention, in that the priming particle generating member includes a material having a work function of 4.2 eV or less.

According to the plasma display panel of the fiftieth-first invention, the priming effect is further exerted by providing the priming particle generating member. In consequence, a delay of the selective discharge and degradation in discharge probability in relation to a lapse of suspend time from the reset discharge are prevented.

These and other objects and features of the present invention will become more apparent from the following detailed description with reference to the accompanying drawings.

DETAILED DESCRIPTION OF THE PREFERRED EMBODIMENTS

Most preferred embodiment according to the present invention will be described hereinafter in detail with reference to the accompanying drawings.

Figure 1:
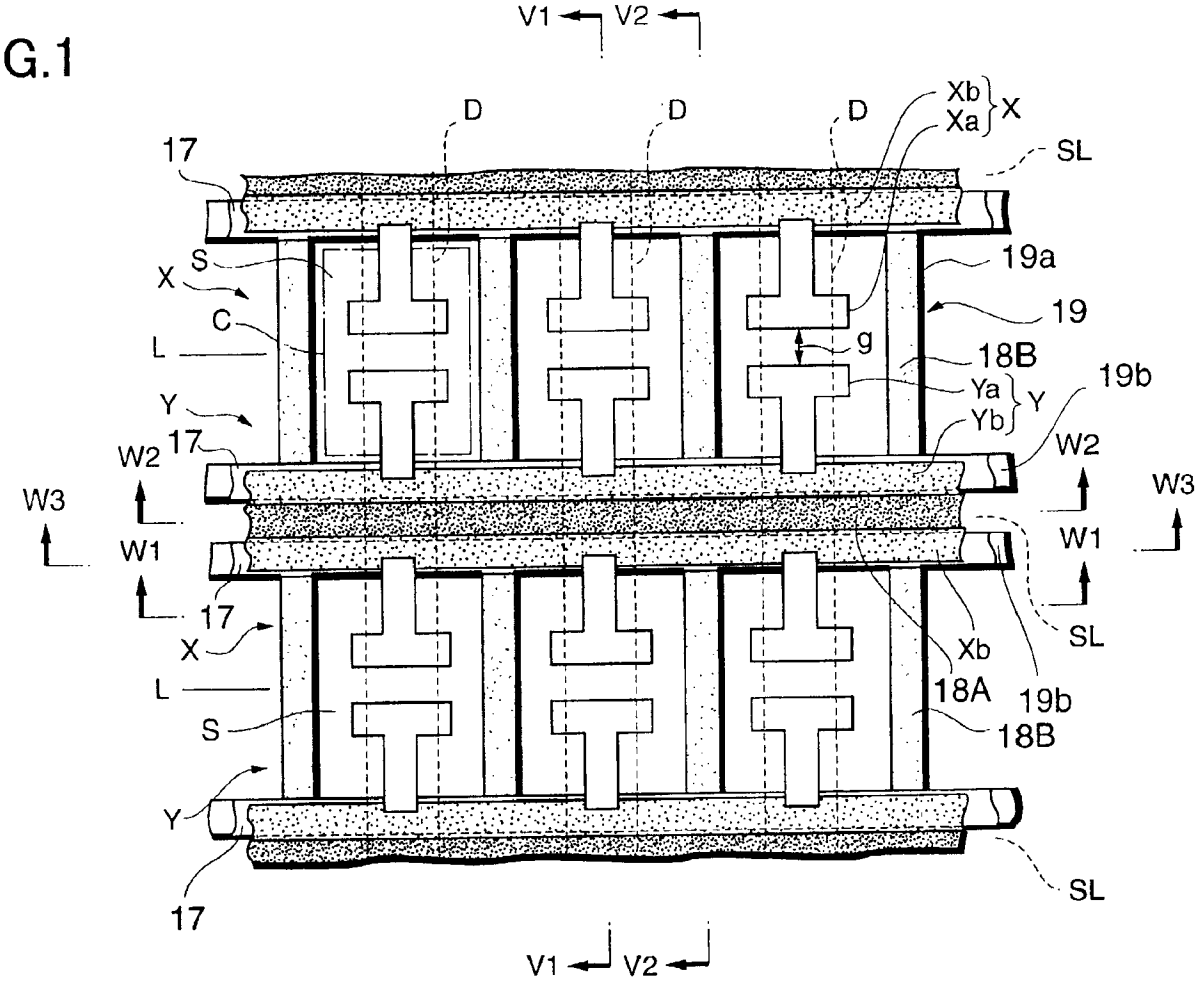
FIG. 1 is a front view schematically illustrating a first example according to the present invention.
Figure 2:
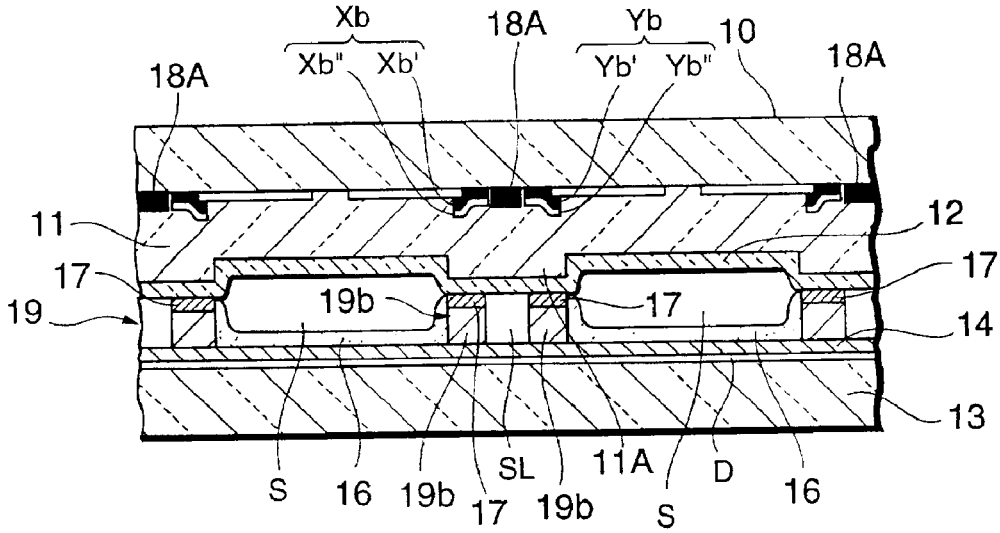
FIG. 2 is a section view taken along the V1—V1 line of FIG. 1.
Figure 3:
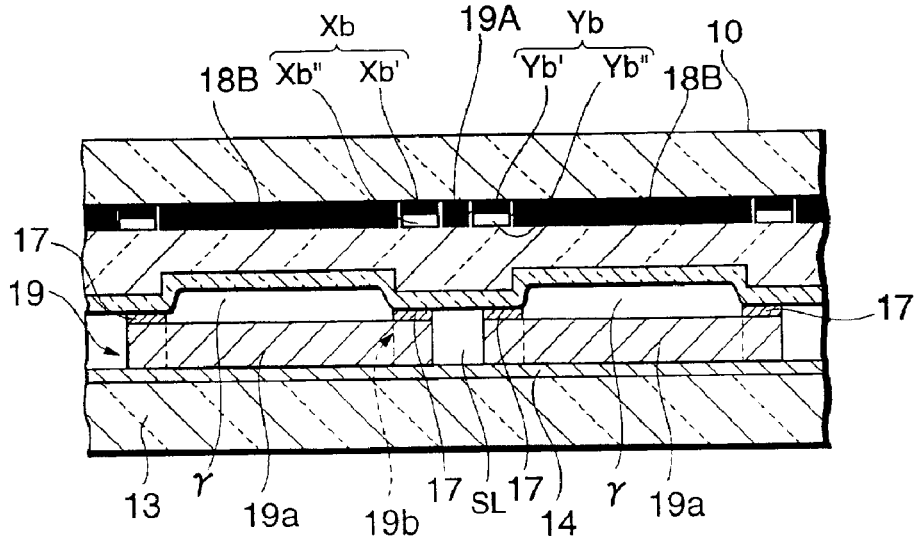
FIG. 3 is a section view taken along the V2—V2 line of FIG. 1.
Figure 4:
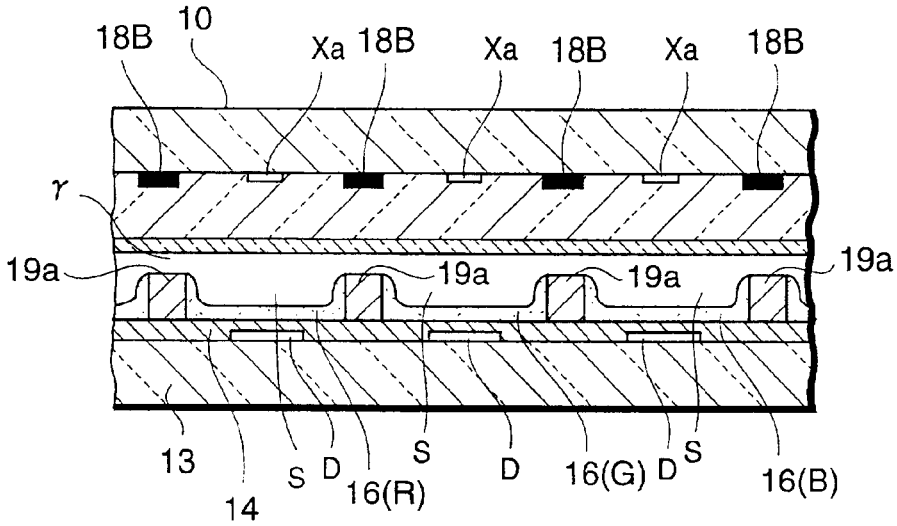
FIG. 4 is a section view taken along the W1—W1 line of FIG. 1.
Figure 5:
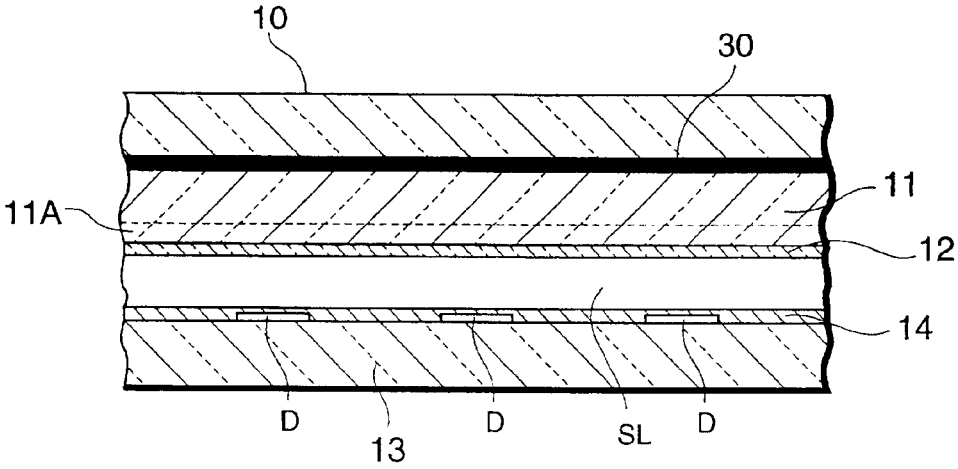
FIG. 5 is a section view taken along the W2—W2 line of FIG. 1.
Figure 6:
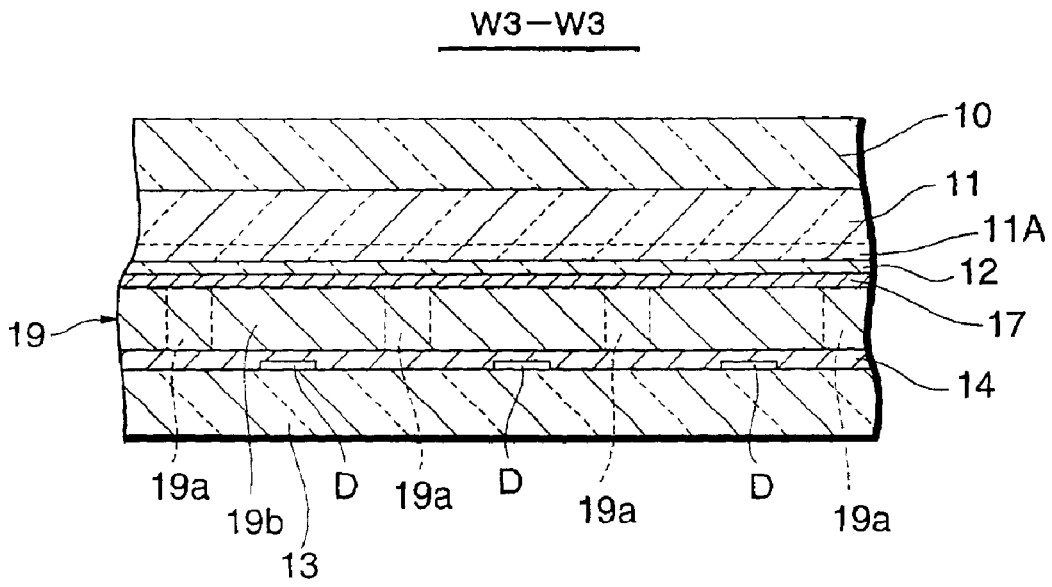
FIG. 6 is a section view taken along the W3—W3 line of FIG. 1.

FIGS. 1 to 6 illustrate a first example of an embodiment of a plasma display panel (hereinafter referred to as "PDP") according to the present invention. FIG. 1 is a front view schematically illustrating the PDP in the first example. FIG. 2 is a section view taken along the V1—V1 line of FIG. 1. FIG. 3 is a section view taken along the V2—V2 line of FIG. 1. FIG. 4 is a section view taken along the W1—W1 line of FIG. 1. FIG. 5 is a section view taken along the W2—W2 line of FIG. 1. FIG. 6 is a section view taken along the W3—W3 line of FIG. 1.

In the PDP illustrated in FIGS. 1 to 6, a plurality of row electrode pairs (X, Y) are arranged in parallel on a back face of a front glass substrate 10 serving as a display surface and extend in a row direction (the right-left direction in FIG. 1) of the front glass substrate 10.

The row electrode X is made up of transparent electrodes Xa formed in a T-like shape of a transparent conductive film made of ITO or the like, and a bus electrode Xb which is formed of metal film extending in the row direction of the front glass substrate 10 and connects to a narrowed proximal end of each transparent electrode Xa.

Likewise, the row electrode Y made up of transparent electrodes Ya formed in a T-like shape of a transparent conductive film made of ITO or the like, and a bus electrode Yb which is formed of a metal film extending in the row direction of the front glass substrate 10 and connects to a narrowed proximal end of each transparent electrode Ya.

The row electrodes X and Y are alternately disposed in a column direction of the front glass substrate 10 (in the vertical direction in FIG. 1). The transparent electrodes Xa and Ya arranged along the respective bus electrodes Xb and Yb extend toward the row electrode as the pair to each other such that the top sides of the widened portions of the transparent electrodes Xa and Ya oppose each other on the opposite sides of a discharge gap g having a predetermined width.

Each of the bus electrodes Xb, Yb is formed in a double-layer structure with a black conductive layer Xb', Yb' on the display surface side and a main conductive layer Xb", Yb" on the back substrate side.

On the back face of the front glass substrate 10 and between the back-to-back bus electrodes Xb and Yb of the respective row electrode pairs (X, Y) adjacent to each other in the column direction, a black light absorption layer (light-shield layer) 18A extends along the bus electrodes Xb, Yb in the row direction. Additionally, a light absorption layer (light-shield layer) 18B is provided at a position opposing a vertical wall 19*a* of a partition wall 19.

On the back face of the front glass substrate 10, further, a dielectric layer 11 overlays the row electrode pairs (X, Y). On the back face of the dielectric layer 11, an additional dielectric layer 11A juts out of the back face of the dielectric layer 11 at a position opposing the adjacent bus electrodes Xb and Yb of the respective row electrode pairs (X, Y) adjacent to each other, and opposing an area between the adjacent bus electrodes Xb and Yb, and extends in parallel to the bus electrodes Xb, Yb.

On the back faces of the dielectric layer 11 and the additional dielectric layers 11A, a protective layer (protective dielectric layer) 12 made of MgO is provided.

Next, a back glass substrate 13 is disposed in parallel to the front glass substrate 10. On the front face of the back glass substrate 13 on the display surface side, column electrodes D are arranged in parallel at regularly established intervals from each other and extend in the direction perpendicular to the row electrode pairs (X, Y) (in the column direction), at positions opposing the paired transparent electrodes Xa and Ya of each row electrode pair (X, Y).

A white dielectric layer 14 is further provided on the front face of the back glass substrate 13 on the display surface side, and the partition wall 19 is provided on the dielectric layer 14.

Each of the partition walls 19 is formed in a ladder pattern by vertical walls 19*a* extending in the column direction between the adjacent column electrodes D disposed in parallel to each other, and transverse walls 19*b* extending in the row direction at positions opposing the additional dielectric layers 11A.

The ladder-patterned partition wall 19 defines the space between the front glass substrate 10 and the back glass substrate 13 into each portion facing the paired transparent electrodes Xa and Ya of each row electrode pair (X, Y) to form quadrangular discharge spaces S.

The face of the vertical wall 19*a* of the partition wall 19 on the display surface side is out of contact with the protective layer 12 (see FIGS. 3 and 4) to form a clearance r therebetween. The face of the transverse wall 19 on the display surface side is also out of direct contact with the portion of the protective layer 12 which overlays the additional dielectric layer 11A (see FIGS. 2, 3 and 5).

On the five faces of a front face of the dielectric layer 14 and side faces of the vertical walls 19*a* and transverse walls 19*b* of the partition wall 19 which face the discharge space S, a phosphor layer 16 overlays all the five faces in each discharge space S.

The phosphor layers 16 are set in order of red (R), green (G) and blue (B) for the sequence of discharge spaces S in the row direction (see FIG. 4).

The inside of the discharge space S is filled with a discharge gas containing xenon Xe.

A transverse wall 19*b* of a ladder-patterned partition wall 19 which defines the discharge spaces S is separated from a transverse wall 19*b* of an adjacent partition wall 19 in the column direction by an interstice SL provided at a location overlapping the light absorption layer 18A between the display lines.

In other words, each of the ladder-patterned partition walls 19 extends along the direction of the display line (row) L, and the adjacent partition walls 19 are disposed in parallel to each other in the column direction on opposite sides of the interstice SL extending along the discharge line L.

A width of each transverse wall 19*b* is set to be approximately equal to a width of each vertical wall 19*a*.

Additionally, for the PDP, as illustrated in FIGS. 2, 3 and 6, an ultraviolet region light emissive layer (priming particle generating member) 17 is provided at a portion on the back face of the protective layer 12 opposing a face of the transverse wall 19*b* of each partition wall 19 on the display surface side. The ultraviolet region light emissive layer 17 is in contact with the face of the transverse wall 19*b* on the display surface side to shield each discharge space S from the interstice SL.

It should be noted that the ultraviolet region light emissive layer 17 may be provided on the face of the transverse wall 19*b* of the partition wall 19 on the display surface side.

The ultraviolet region light emissive layer 17 is made of ultraviolet region light emitting phosphor having the persistence characteristics allowing continuous radiation of ultraviolet light for 0.1 msec or more, preferably, 1 msec or more (i.e. approximate length of time of the addressing period Wc) as a result of excitation by vacuum ultraviolet rays of 147 nm in wavelength which are radiated by a discharge from xenon Xe included in the discharge gas filled in the discharge space S.

Examples of the ultraviolet region light emitting phosphor having such persistence characteristics include $BaSi_2O_5:Pb^{2+}$ (a wavelength of emitted light: 350 nm), $SrB_4O_7F:Eu^{2+}$ (wavelength of emitted light: 360 nm), $(Ba, Mg, Zn)_3Si_2O_7:Pb^{2+}$ (wavelength of emitted light: 295 nm), $YF_3$:Gd, Pr, and so on.

In the above-mentioned PDP, each row electrode pair (X, Y) forms a display line (row) L on the matrix display screen. Each discharge space S defined by the ladder-patterned partition wall 19 defines a discharge cell C.

Figure 40:
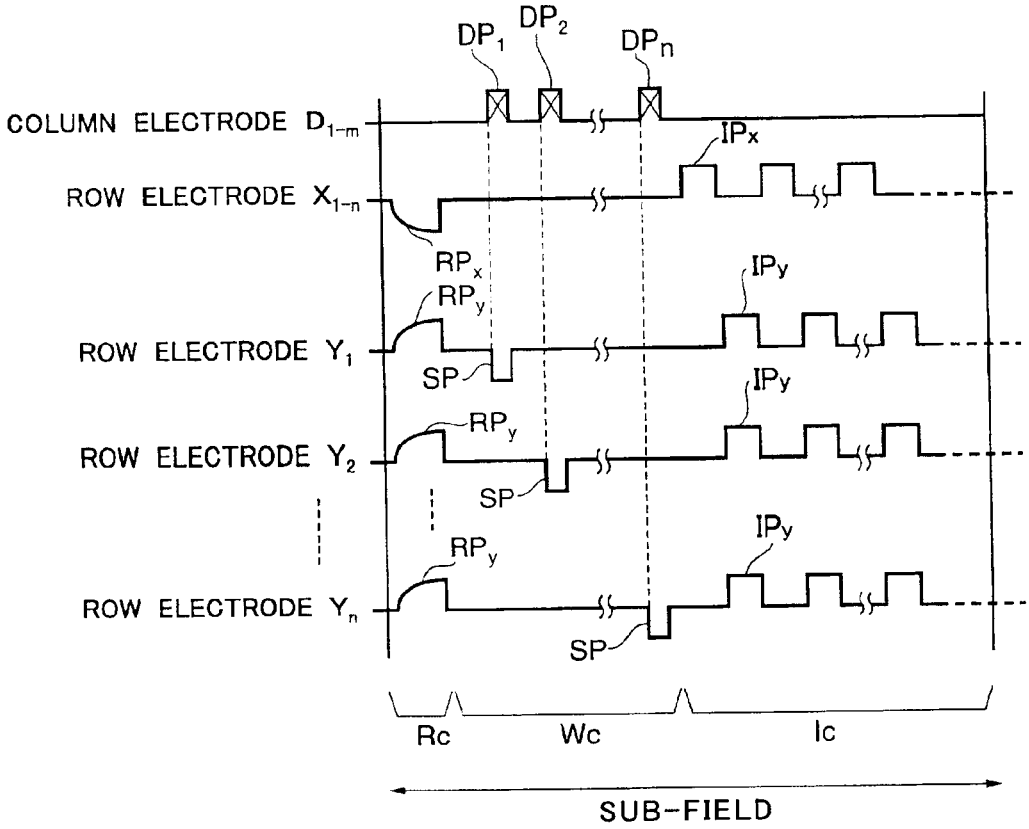
FIG.40 PRIOR ART
FIG. 40 is a time chart showing a sub-field method in a plasma display panel.

Images are displayed on the PDP by the sub-field method as in the case having been discussed in FIG. 40.

Specifically, after the concurrent reset, the selective discharge is operated between the row electrode pair (X, Y) and the column electrode D in each discharge cell through the addressing operation. This scatters the lighted cells (the discharge cells C in which the wall charge is formed on the dielectric layer 11) and the non-lighted cells (the discharge cells C in which the wall charge is not formed on the dielectric layer 11) in all the display lines L throughout the panel in accordance with the image to be displayed.

After the addressing operation, in all the display lines L, discharge sustain pulses are applied alternatively to the row electrode pairs (X, Y) at intervals corresponding to the weight of each sub-field in unison. A surface discharge is initiated in each lighted cell in every application of the discharge sustain pulse to generate ultraviolet light. By the generated ultraviolet light, each R, G, B phosphor layer 16 in the discharge space S is excited to emit light, resulting in generating a display screen.

As described above, the images are generated on the PDP. In the reset discharge when an image is generated, the 147 nm-wavelength vacuum ultraviolet rays radiated from xenon Xe in the discharge gas excite the ultraviolet region light emissive layer 17 provided on the back face of the protective layer 12 to emit ultraviolet light.

The ultraviolet light emitted from the ultraviolet region light emissive layer 17 causes the protective layer (MgO layer) 12 to emit secondary electrons, and thus priming particles are continuously regenerated in the discharge space of the discharge cell C during the addressing period Wc in one sub-filed (see FIG. 40). This inhibits a reduction of the amount of priming particles in each lighted cell.

Thus, by inhibiting the reduction of the amount of priming particles in each lighted cell, an increase of the discharge delay time is inhibited even in a display line in which a time interval increases until scan pulses are applied in the subsequent addressing period Wc after the concurrent reset period Rc. Moreover, producing variations of the discharge delay time is also inhibited. Therefore, even when a pulse width of the scan pulse or the display data pulse is narrow, it is prevented that the selective discharge operation in the addressing period Wc becomes unstable to produce a false discharge. This results in generation of images with high quality.

Figure 7A:
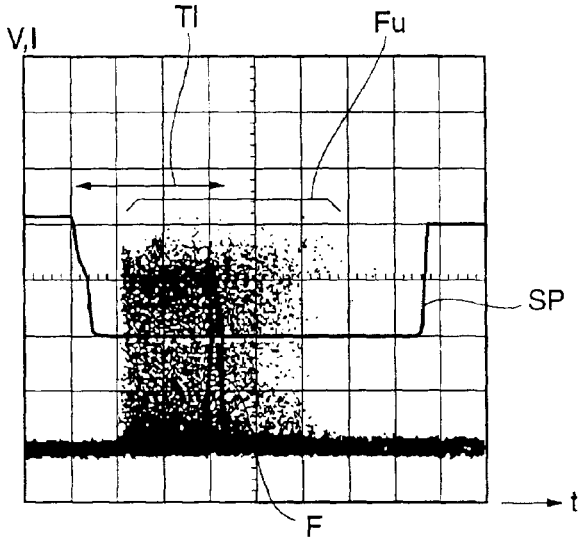
FIG. 7A is a graph illustrating a discharge delay time and variations of the discharge delay time in case that an ultraviolet region light emissive layer is provided in the example.

FIG. 7A is a graph showing the results of measurement of a discharge delay time and variations of discharge light emission using an oscillograph in the above PDP, where F is the discharge light emission, T1 is the discharge delay time and Fu is the variation of discharge light emission.

Figure 7B:
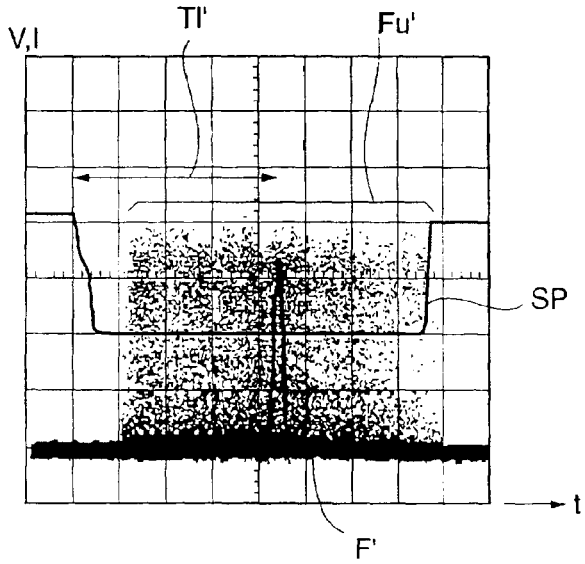
FIG. 7B is a graph illustrating a discharge delay time and variations of the discharge delay time in case that the ultraviolet region light emissive layer is not provided in the example.

From a comparison between the graph in FIG. 7A and the graph in FIG. 7B showing a discharge delay time T1' and variations of discharge light emission Fu' without the ultraviolet region light emissive layer 17, it is seen that both the discharge delay time and the variation of discharge light emission decrease.

The PDP is constructed such that the transverse walls 19*b* of the respective partition walls 19 adjacent to each other in the column direction are spaced from each other by the interstice SL extending in the row direction, and a width of each transverse wall 19*b* is approximately equal to a width of each vertical wall 19*a*. For this reason, the front glass substrate 10 and the back glass substrate 13 may not produce warpage when the partition wall 19 is burned, and the shape of the discharge cell may be not deformed by damage to the partition wall 19, or the like.

In the PDP, portions of the back face of the front glass substrate 10 except for portions thereof facing the discharge spaces S are covered with the light absorption layers 18A, 18B and the black conductive layers Xb', Yb' of the bus electrodes Xb, Yb formed in the double-layer structure. This allows prevention of the reflection of ambient light incident through the front glass substrate 10 and the associated enhancement of contrast on the display screen.

It should be noted that in the first example, any one of the light absorption layers 18A and 18B may be provided.

Further, a color filter layer (not shown) having colors corresponding to the colors (R, G, B) of each phosphor layer 16 in the discharge space S facing the color filter layer can be provided on the back face of the front glass substrate 10 in each discharge cell C.

In this case, the light absorption layers 18A, 18B are provided in a space between the color filter layers, formed in an island pattern and facing each discharge space S, or on a position corresponding to the space.

Figure 8:
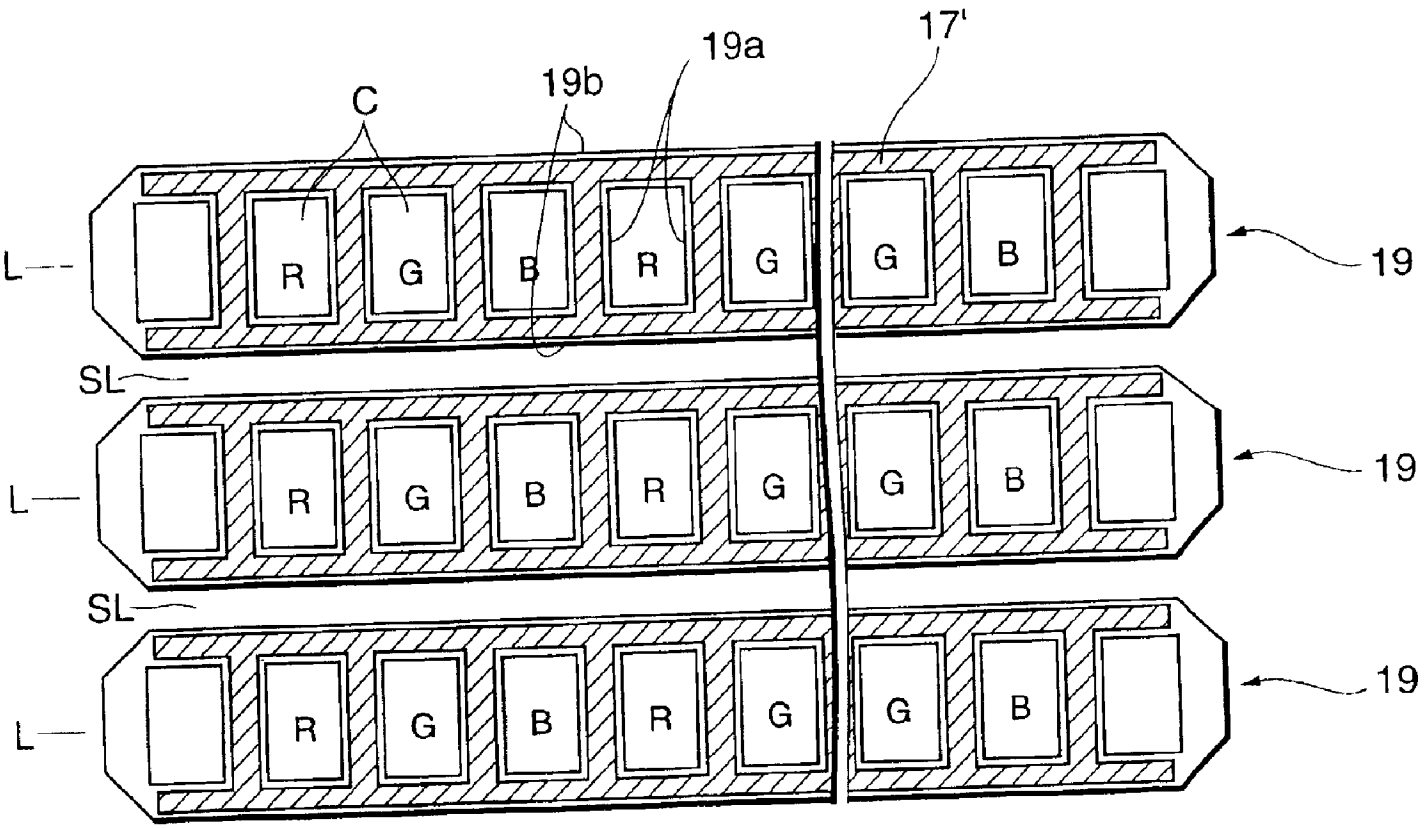
FIG. 8 is a front view illustrating another example of the ultraviolet region light emissive layer.

In the first example, the ultraviolet region light emissive layer 17 is disposed only between the face of the protective layer 12 on the back substrate side and the face of the transverse wall 19*b* of the partition wall 19 on the display surface side. However, as illustrated in FIG. 8, an ultraviolet region light emissive layer 17' may be provided on the face of the vertical wall 19*a* of the partition wall 19 on the display surface side. Alternatively, the ultraviolet region light emissive layer 17' may be provided on the protective layer 12 on the back substrate side opposing the vertical wall 19*a* so as to be disposed in a site facing toward the interior of the discharge space of each discharge cell between the vertical wall 19*a* and the protective layer 12.

This increases an area of the ultraviolet region light emissive layer 17' in contact with the discharge space of the discharge cell C to further inhibit a decrease of the amount of priming particles in the addressing period Wc in one sub-field.

In the first example, the phosphor layer 16 may contain an ultraviolet region light emissive material at a ratio of 1 to 10 wt % to also serve as the ultraviolet region light emissive layer. Specifically, the phosphor layer 16 may contain the ultraviolet region light emissive material having the persistence characteristics allowing emission for 0.1 msec or more to thereby form a combination of the ultraviolet region light emissive layer 17 and the phosphor layer 16.

Figure 9:
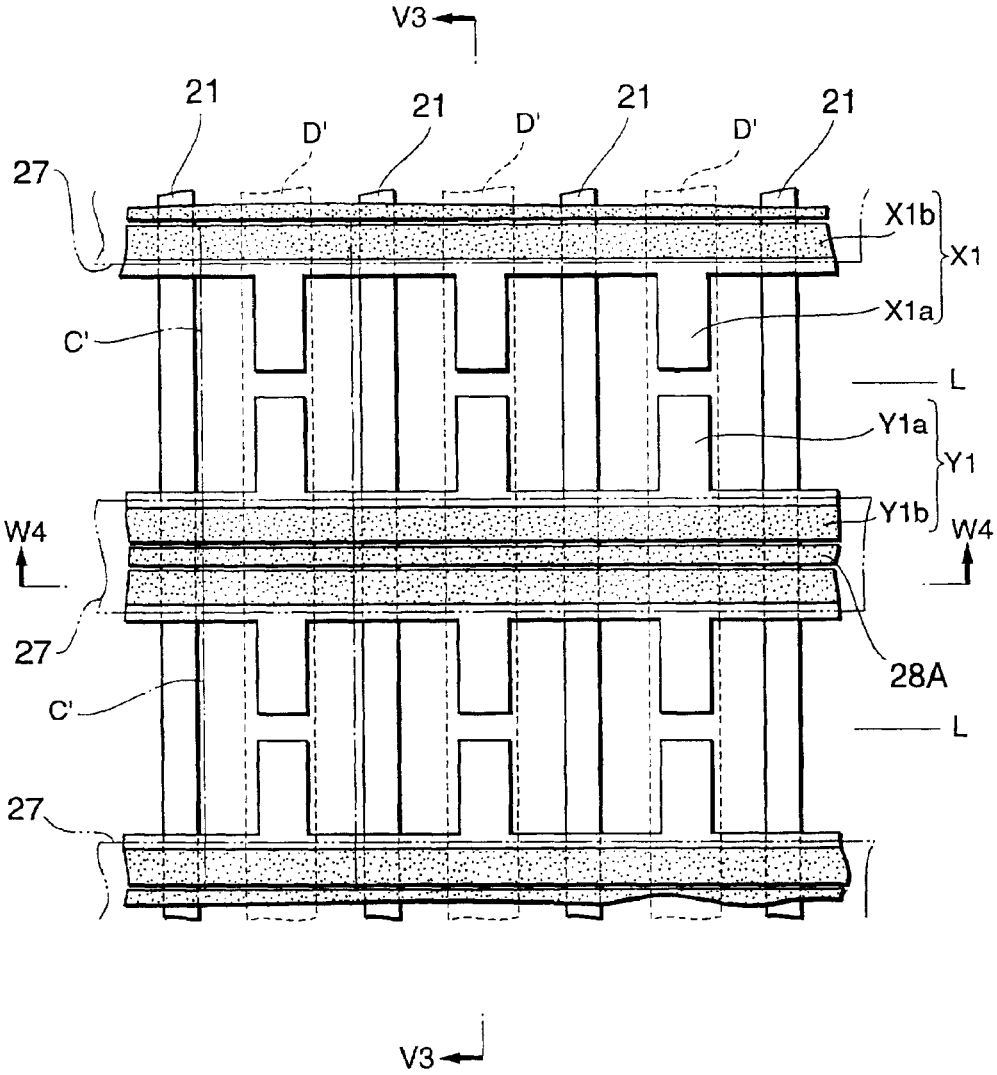
FIG. 9 is a front view schematically illustrating a second example according to the present invention.
Figure 10:
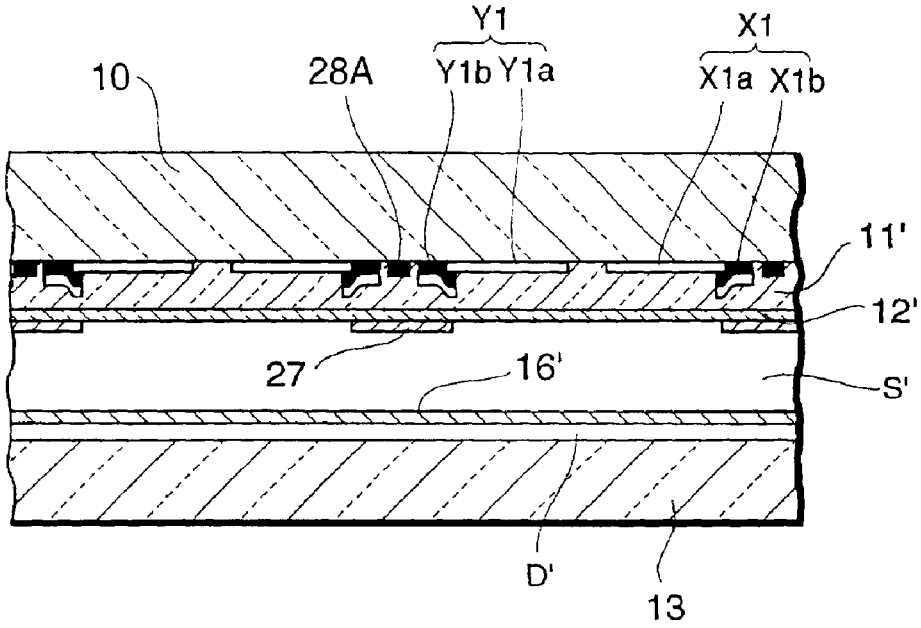
FIG. 10 is a section view taken along the V3—V3 line of FIG. 9.
Figure 11:
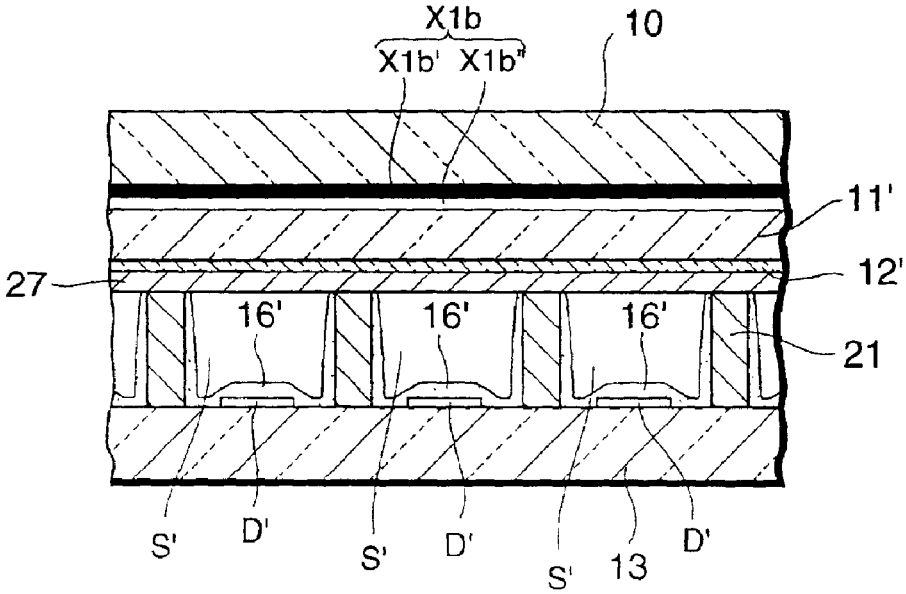
FIG. 11 is a section view taken along the W4—W4 line of FIG. 9.

FIGS. 9 to 11 illustrate a second example of the embodiment of PDP according to the present invention. FIG. 9 is a front view schematically illustrating the PDP in the second example. FIG. 10 is a section view taken along the V3—V3 line in FIG. 9. FIG. 11 is a section view taken along the W4—W4 line in FIG. 9.

In the foregoing first example, the vertical walls and the transverse walls of the partition wall surround the discharge cell at all directions for definition. In contrast, the PDP illustrated in FIGS. 9 to 11 is configured such that a stripe-patterned partition wall 21 extending in the column direction defines a discharge space S' between a front glass substrate 10 and a back glass substrate 13.

The remaining configuration of the PDP is similar to the PDP in the first example except for the shape of transparent electrodes X1*a*, Y1*a* of row electrode X1, Y1, and no provision of the additional dielectric layer in a dielectric layer 11. Bus electrode X1*b*, Y1*b* of the row electrode X1, Y1 is formed in a double-layer structure of a black conductive layer X1*b*', Y1*b*' situated on the display surface side and a main conductive layer X1*b*", Y1*b*" situated on the back substrate side. On the back face of the front glass substrate 10, a black light absorption layer (light shield layer) 28A extends in the row direction along the bus electrode X1*b*, Y1*b* between the back-to-back bus electrodes X1*b* and Y1*b* of the respective row electrode pairs (X1, Y1) adjacent to each other in the column direction.

At a portion of a dielectric layer 11' on the back substrate side opposing back-to-back bus electrodes X1*b* and Y1*b* and the light absorption layer 28A provided between the back-to-back bus electrodes X1*b* and Y1*b*, a ultraviolet region light emissive layer (priming particle generating member) 27 extends in the row direction and faces toward the discharge space S'.

In the second example, as in the first example, in a reset discharge when an images is generated, vacuum ultraviolet rays radiated from xenon Xe in a discharge gas excite the ultraviolet region light emissive layer 27, provided on the back face of a protective layer 12', to emit ultraviolet light.

The emitted ultraviolet light continues regenerating priming particles in the discharge space of the discharge cell during an addressing period in one sub-filed. This inhibits a reduction of the amount of priming particles in each lighted cell. For this reason, an increase of a discharge delay time in the subsequent addressing period is inhibited, and also, producing variations of the discharge delay time is suppressed.

Although the PDP in the second example does not provide the partition wall for defining each discharge cell C' in the column direction, the transparent electrodes X1*a*, Y1*a* of the respective row electrodes X1, Y1 protrude from the respective bus electrodes X1*b*, Y1*b* in the column direction to oppose each other, thereby suppressing interference between discharges in the adjacent discharge cells C' in the column direction.

Figure 12:
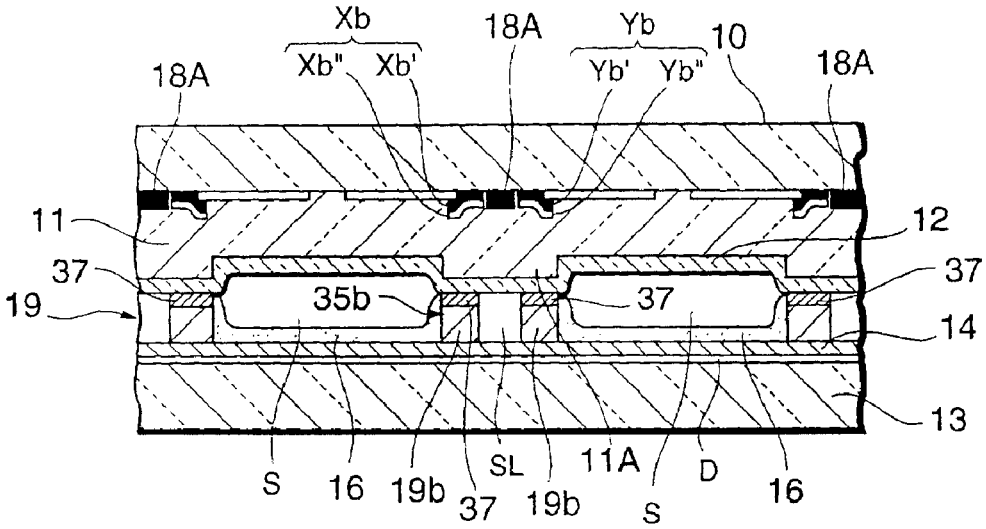
FIG. 12 is a vertical section view illustrating a third example according to the present invention.
Figure 13:
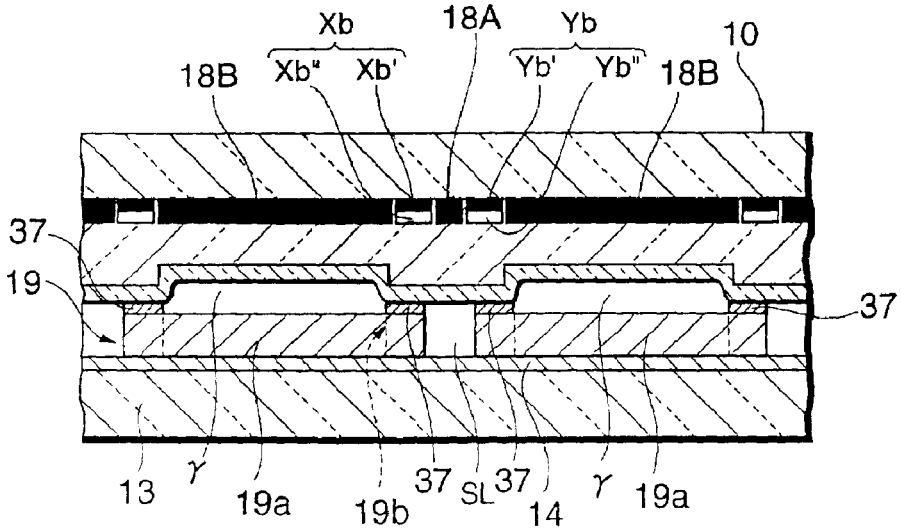
FIG. 13 is a vertical section view illustrating another portion of the third example.

FIGS. 12 and 13 illustrate a third example in the embodiment of the PDP according to the present invention. FIG. 12 is a vertical section view of the same portion as that illustrated in FIG. 2 of the first example, while FIG. 13 is a vertical section view of the same portion as that illustrated in FIG. 3 of the first example.

In the third example, at the same site as that of the ultraviolet region light emissive layer 17 of the foregoing first example, a secondary electron emissive layer (priming particle generating member) 37 is provided instead of the ultraviolet region light emissive layer 17. The secondary electron emissive layer 37 includes a material having a higher coefficient of secondary electron emission (a smaller work function) than that of MgO making up a protective layer 12 which overlays a dielectric layer 11 and an additional dielectric layer 11A.

The secondary electron emissive layer 37 is in contact with the face of a transverse wall 19*b* on the display surface side while facing toward the interior of the discharge space S to shield each discharge space S from an interstice SL.

The configuration of other components of the PDP is the same as those of the PDP illustrated in FIGS. 1 to 6 and the same reference numerals are assigned.

It should be mentioned that the secondary electron emissive layer 37 may be provided on the face of the transverse wall 19*b* of the partition wall 19 on the display surface side.

The reason of providing the secondary electron emissive layer 37 is as follows.

The protective layer 12 made of MgO serves a facility to protect the dielectric layer 11 and the additional dielectric layer 11A from the impact of ions, and a facility to emit secondary electrons into the discharge space S by the discharge to generate priming particles. By providing the secondary electron emissive layer 37 made of the material having a higher coefficient of secondary electron emission (a smaller work function) than that of MgO, the amount of secondary electrons emitted into the discharge space S is increased.

Examples of the material having a high coefficient of secondary electron emission and insulation properties for providing the secondary electron emissive layer 37, include oxides of alkali metals (e.g. $Cs_2O$), oxides of alkali-earth metals (e.g. CaO, SrO, BaO), fluorides ($CaF_2$, $MgF_2$), and the like.

At this point, these materials have a higher coefficient of secondary electron emission than that of MgO but a smaller strength for the impact of ions than that of MgO. Accordingly, since the materials are inferior in terms of protection for the dielectric layer 11, it is preferable to provide the protective layer 12 independently.

The secondary electron emissive layer 37 may be formed of materials of which a coefficient of secondary electron emission is increased as a result of the introduction of impurity level into crystals caused by crystal defects or impurities.

For example, the secondary electron emissive layer 37 can be formed of a material of which a coefficient of secondary electron emission is increased by means of changing the composition ratio into 1:1 as MgOx to introduce crystal defects.

The images are generated on the PDP as in the first example, but in the reset discharge when the image is generated, the visible light radiated from the R, G or B phosphor layer 16 in each discharge cell C excites the material having a high coefficient of secondary electron emission (a small work function) and making up the secondary electron emissive layer 37, to allow the secondary electron emissive layer 37 to emit secondary electrons into the discharge cell.

At this time, the red ((Y, Gd)$BO_3$:Eu) phosphor layer 16 (i.e. R phosphor layer) and the green ($Zn_2SiO_4$:Mn) phosphor layer 16 (i.e. G phosphor layer), continue emitting the visible light for more than several milliseconds by the reset discharge. Due to the emitted visible light, the secondary electron emissive layer 37 emits the secondary electrons during the addressing period Wc in one sub-field (see FIG. 40). Due to the emitted secondary electrons, priming particles are regenerated, resulting in inhibiting a reduction of the amount of priming particles in the discharge cell C.

Thus, by inhibiting the reduction of the amount of priming particles, an increase of a discharge delay time in the addressing period Wc is inhibited, and also producing variations of the discharge delay time is inhibited. Therefore, even when a pulse width of the scan pulse SP (see FIG. 40) and the display data pulse are narrow, it is prevented that the selective discharge operation in the addressing period Wc becomes unstable to produce a false discharge. This allows the generation of images with high quality and a reduction of the time of the addressing period.

Figure 14:
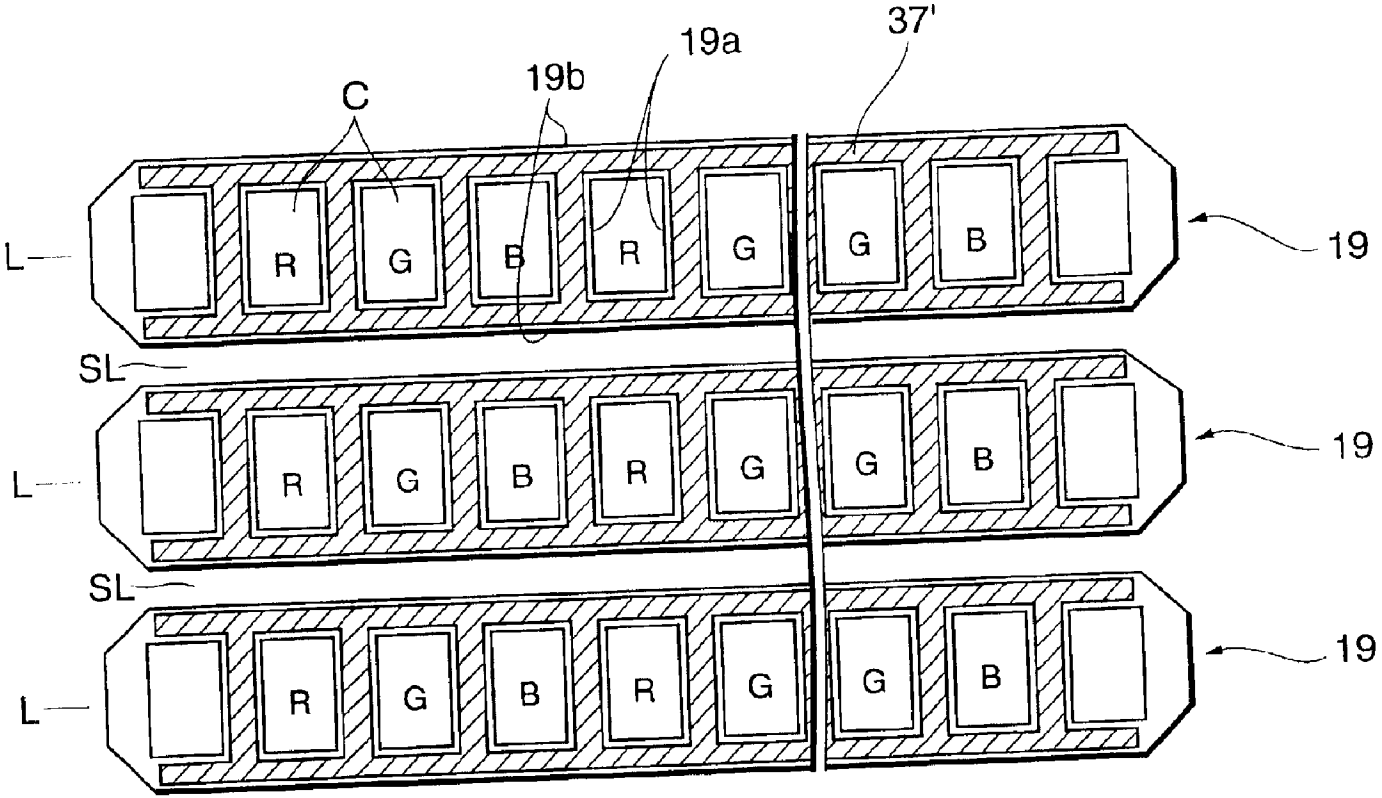
FIG. 14 is a front view illustrating another example of a secondary electron emissive layer.

In the third example of FIGS, 12 and 13, the secondary electron emissive layer 37 is disposed only between the face of the protective layer 12 on the back substrate side and the face of the transverse wall 19*b* of the partition wall 19 on the display surface side. However, as illustrated in FIG. 14, a secondary electron emissive layer 37' may be provided on the face of the vertical wall 19*a* of the partition wall 19 on the display surface side. Alternatively, the secondary electron emissive layer 37' may be provided on the protective layer 12 on the back substrate side opposing the vertical wall 19*a* so as to be disposed at a site facing toward the interior of the discharge space of each discharge cell between the vertical wall 19*a* and the protective layer 12.

This increases an area of the secondary electron emissive layer 37' in contact with the discharge space of the discharge cells C to increase the amount of emission of secondary electrons, and therefore a sufficient amount of priming particles in the addressing period Wc in one sub-field can be ensured.

In the third example, the phosphor layer 16 may include a material having a high coefficient of secondary electron emission (a small work function) to serve also as the secondary electron emissive layer.

A secondary electron emissive layer may be coated on the inner wall-face of the partition wall 19 (between the phosphor layer 16 and the side wall face of the partition wall 19). Alternatively, the partition wall 19 may include the material having a high coefficient of secondary electron emission.

Alternatively, a secondary electron emissive layer may be coated on a portion of the protective layer on the front glass substrate 10 side which does not oppose the row electrodes X, Y.

Further alternatively, a secondary electron emissive layer can be coated on the dielectric layer 14 on the back glass substrate 13 side (between the dielectric layer 14 and the phosphor layer 16), or the dielectric layer 14 may include the material having a high coefficient of secondary electron emission.

In the PDP of each example described hereinbefore, a light emissive layer can face toward the interior of the discharge space in each discharge cell C in order to increase secondary electrons emitted from the protective layer 12 and secondary electron emissive layer 37, or the phosphor layer 16 containing the material having a high coefficient of secondary electron emission, resulting from radiation of excitation light which excites the material of a high coefficient of secondary electron emission.

As a type of such a light emissive layer, there are an ultraviolet region light emissive layer and a visible region light emissive layer.

The ultraviolet region light emissive layer is made of ultraviolet region light emitting phosphor having the persistence characteristics allowing continuous emission of ultraviolet light for 0.1 msec or more, preferably, 1 msec or more (i.e. approximate length of time of the addressing period Wc) resulting from excitation by 147 nm-wavelength vacuum ultraviolet rays which are radiated by a discharge from xenon Xe included in a discharge gas filled in the discharge space S.

Examples of the ultraviolet region light-emitting phosphor having such persistence characteristics, include $BaSi_2O_5:Pb^{2+}$ (a wavelength of emitted light: 350 nm), $SrB_4O_7F:Eu^{2+}$ (wavelength of emitted light: 360 nm), (Ba, Mg, Zn)$_3Si_2O_7:Pb^{2+}$ (wavelength of emitted light: 295 nm), $YF_3$:Gd, Pr, and so on.

The visible region light emissive layer is made of visible region light emitting phosphor having the persistence characteristics allowing continuous radiation of visible light for 0.1 msec or more, preferably, 1 msec or more (i.e. approximate length of time of the addressing period Wc) resulting from excitation by 147 nm-wavelength vacuum ultraviolet rays radiated from xenon Xe by the discharge.

Examples of the visible region light emissive layer having such a persistence characteristics, are phosphor materials such as red R ((Y,Gd)$Bo_3$:Eu) and green G ($Zn_2SiO_4$:Mn), and the like.

The ultraviolet region light emissive layer and the visible region light emissive layer are excited by 147 nm-wavelength vacuum ultraviolet rays radiated from xenon Xe in the discharge gas by the discharge, and thus radiate ultraviolet light.

The ultraviolet light emitted from the ultraviolet region light emissive layer or the visible region emissive layer allows secondary electrons to be emitted from the protective layer (Mgo layer) 12 and the secondary electron emissive layer 37 or the phosphor layer 16 including the material having a high coefficient of secondary electron emission, and thus priming particles are continuously regenerated in the discharge space of the discharge cell C during the addressing period Wc in one sub-filed (see FIG. 40). This inhibits a reduction of the amount of priming particles in each lighted cell.

Accordingly, the ultraviolet light radiated from the ultraviolet region light emissive layer or the visible region light emissive layer, increases the amount of secondary electron emission, to further inhibit the reduction of the amount of priming particles in the lighted cell. This further inhibits the extension of a discharge delay time in the addressing period Wc, and the producing of variations of the discharge delay time.

It is possible to provide the ultraviolet region light emissive layer and the visible region light emissive layer, aside from the secondary electron emissive layer 37, at a site facing toward the discharge space in a clearance between the front glass substrate 10 and the partition wall 19. However, the ultraviolet region light emissive layer or the visible region light emissive layer may contain the material having a high coefficient of secondary electron emission (a small work function) to be formed in combination with the secondary electron emissive layer 37.

Alternatively, the ultraviolet region light emissive layer or the visible region light emissive layer together with a material having a high coefficient of secondary electron emission (small work function) can be contained in the phosphor layer 16.

In the above PDP, a color filter layer (not shown) having colors corresponding to the colors (R, G, B) of each phosphor layer 16 in the discharge space S facing the color filter layer can be provided on the back face of the front glass substrate 10 in each discharge cell C.

In this case, the light absorption layers 18A, 18B are provided on a space between the color filter layers, provided in an island pattern and facing each discharge space S, or on a position corresponding to the space.

Figure 15:
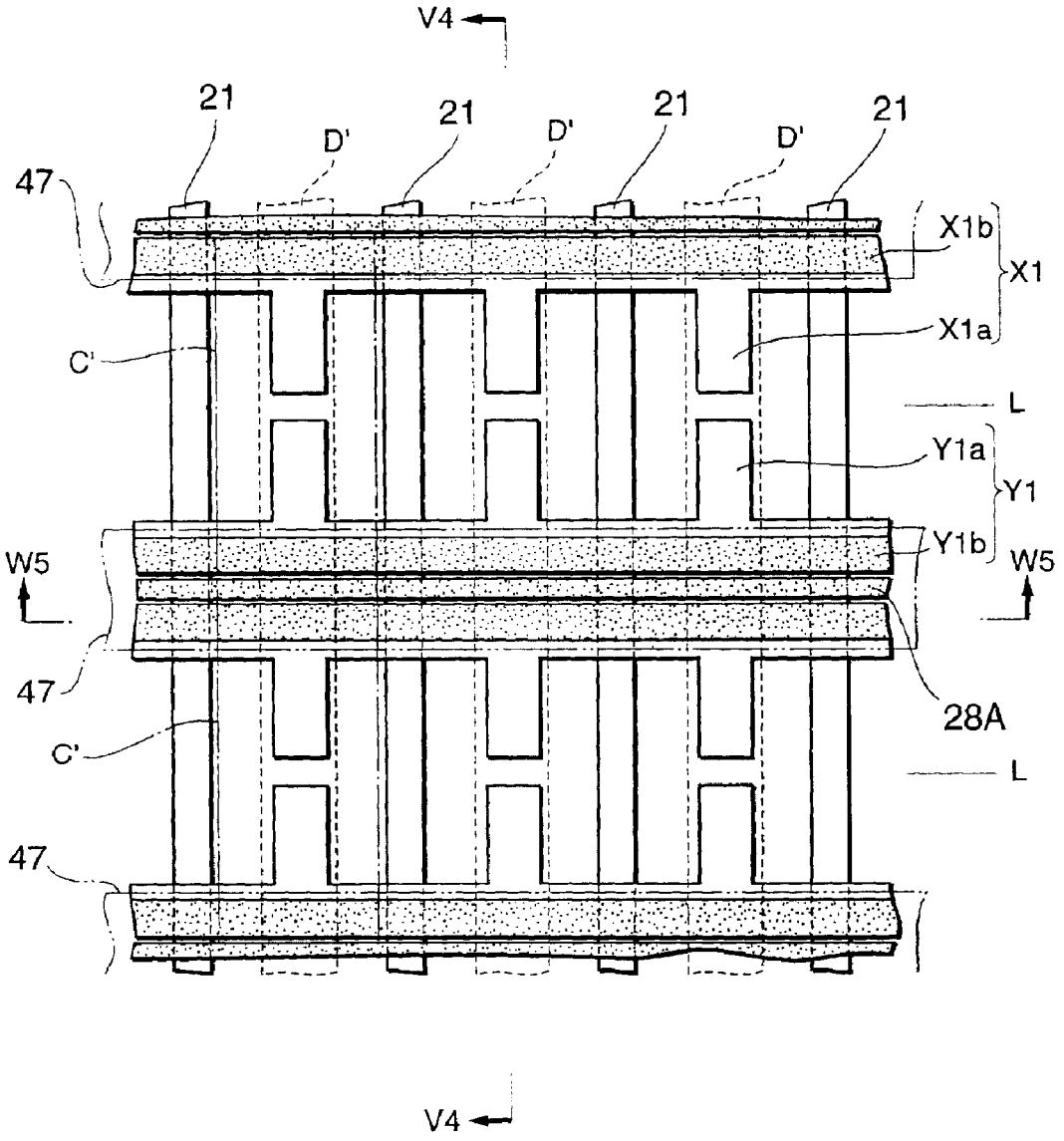
FIG. 15 is a front view schematically illustrating a fourth example according to the present invention.
Figure 16:
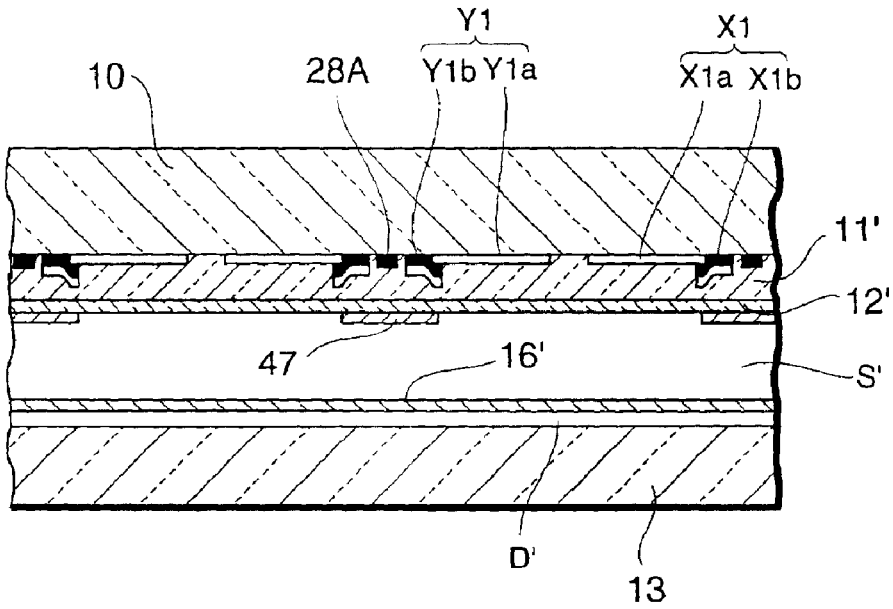
FIG. 16 is a section view taken along the V4—V4 line of FIG. 15.
Figure 17:
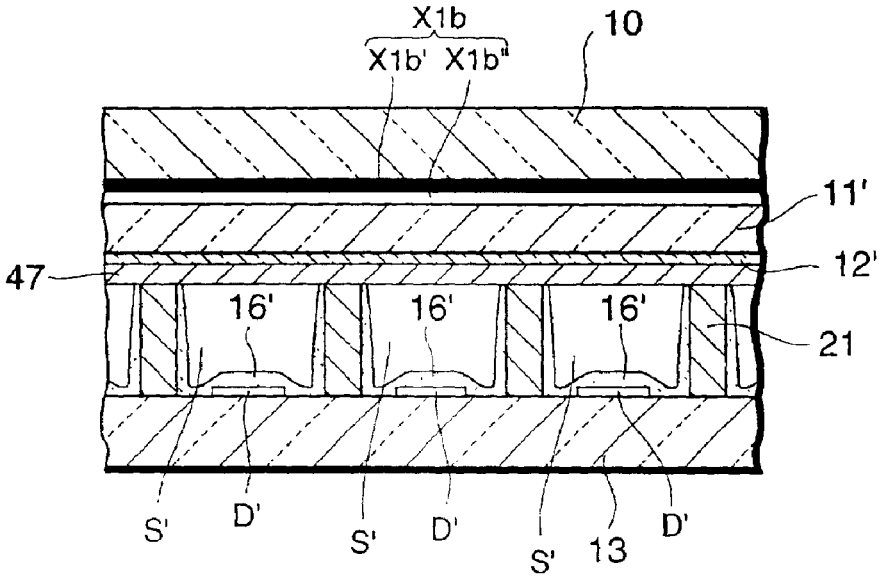
FIG. 17 is a section view taken along the W5—W5 line of FIG. 15.

FIGS. 15 to 17 illustrate a fourth example of the embodiment of the PDP according to the present invention. As in the foregoing second example, in the PDP having a stripe-patterned partition wall 21, instead of the ultraviolet region light emissive layer 27, a secondary electron emissive layer (priming particle generating member) 47 extends along the row direction and faces toward a discharge space S' at the same site as that of the ultraviolet region light emissive layer 27.

In the fourth example, as in the third example, in a reset discharge when an image is generated, the visible light radiated from a phosphor layer 16' in each discharge cell excites a material having a high coefficient of secondary electron emission (a small work function) making up the secondary electron emissive layer 47, to cause secondary electrons to be emitted from the secondary electron emissive layer 47 into the discharge space S' of each discharge cell.

In this way, in addition to secondary electrons emitted from a protective layer 12', secondary electrons are emitted also from the secondary electron emissive layer 47, and thus the amount of priming particles in the discharge spaces S' is ensured sufficiently. For this reason, an increase of a discharge delay time in the addressing period and producing variations of the discharge delay time are further inhibited.

In the fourth example, the secondary electron emissive layer may be provided on a portion of the face of the stripe-patterned partition wall 21 on the display surface side so as to face the discharge space S'.

As in the third example, in the fourth example, an ultraviolet region light emissive layer or a visible region light emissive layer can be provided.

Figure 18:
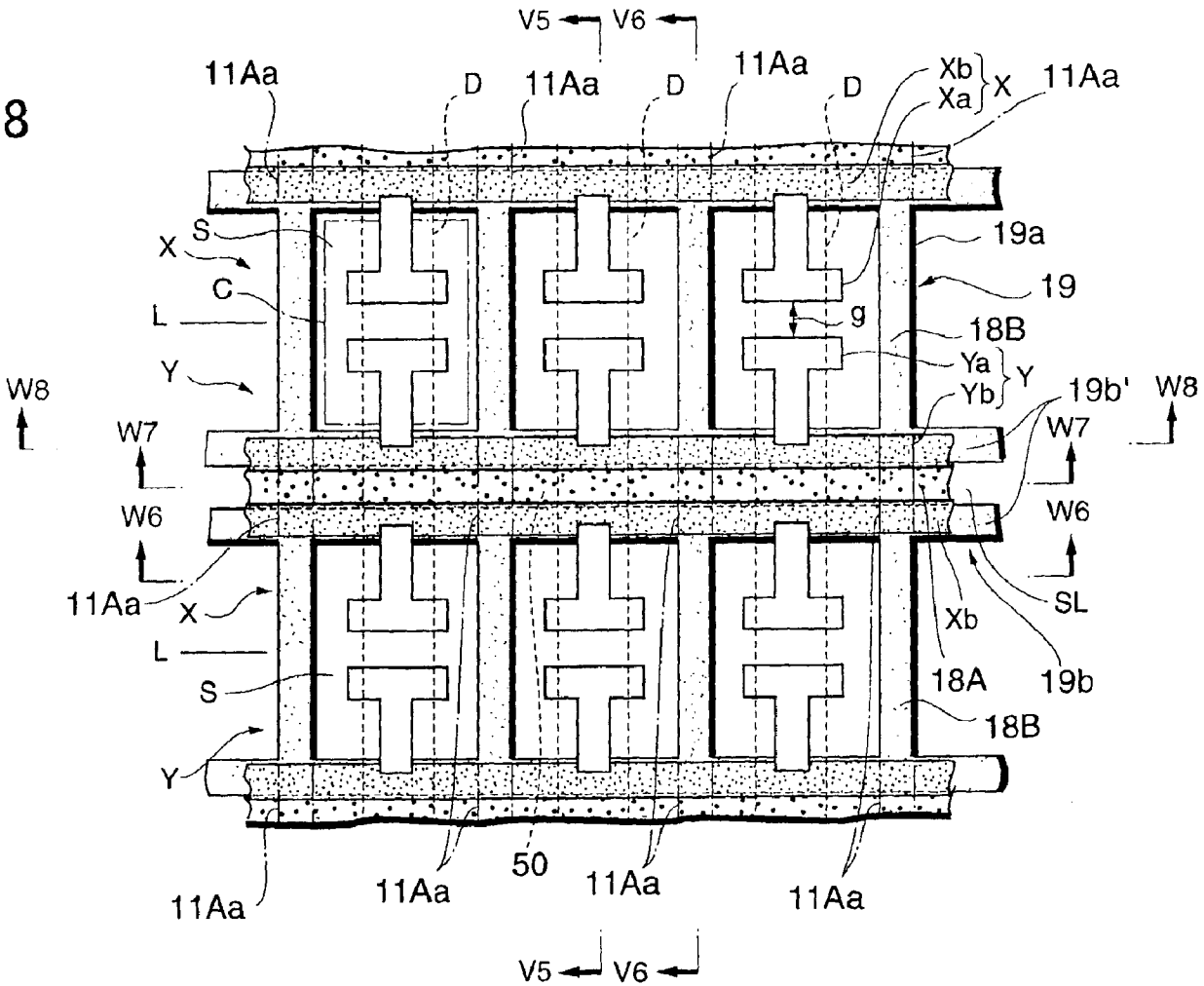
FIG. 18 is a front view schematically illustrating a fifth example according to the present invention.
Figure 19:
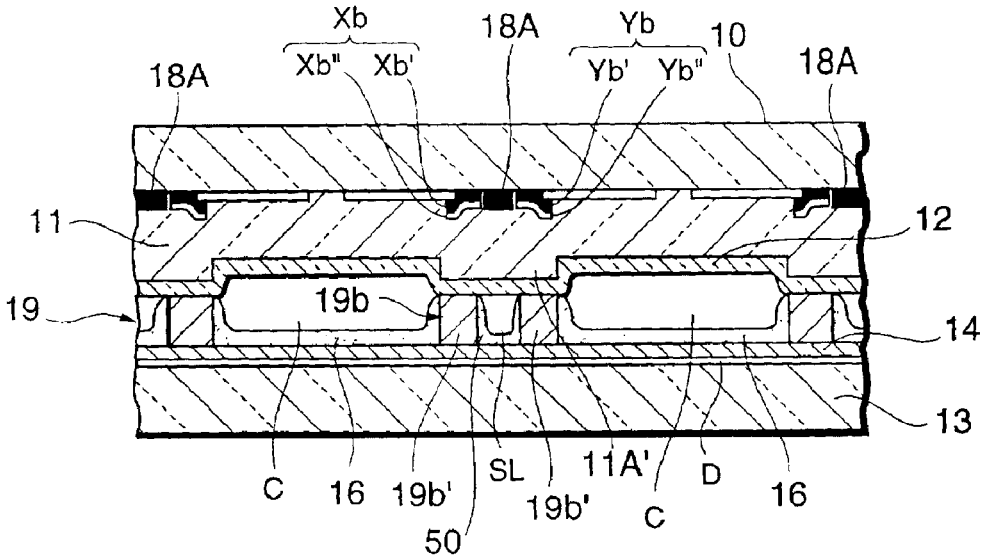
FIG. 19 is a section view taken along the V5—V5 line of FIG. 18.
Figure 20:
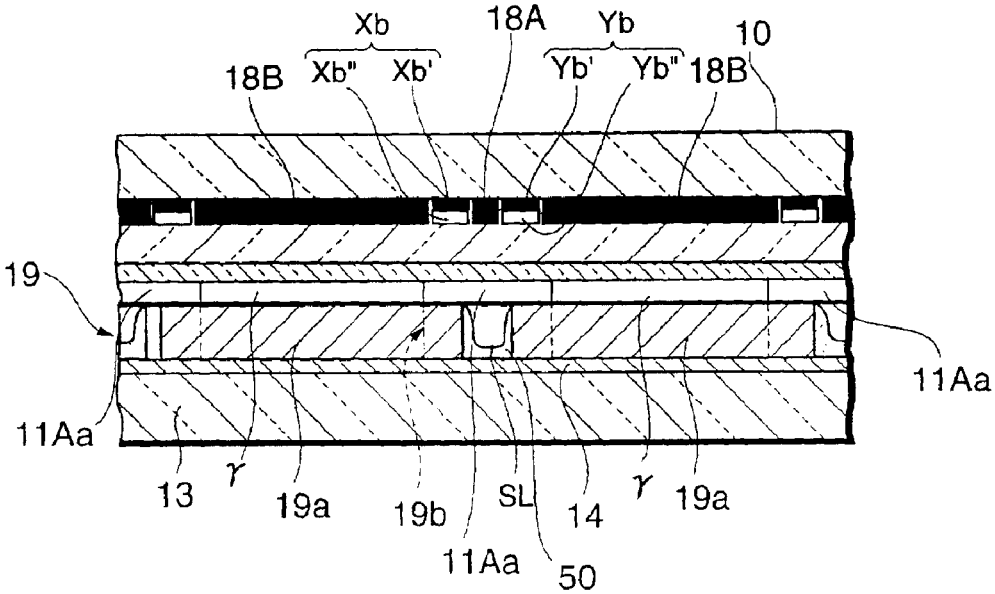
FIG. 20 is a section view taken along the V6—V6 line of FIG. 18.
Figure 21:
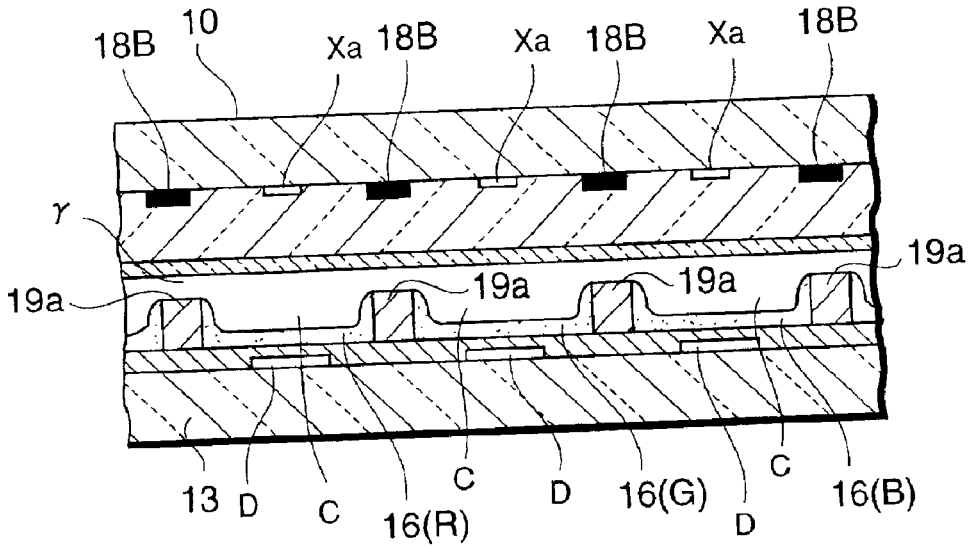
FIG. 21 is a section view taken along the W6—W6 line of FIG. 18.
Figure 22:
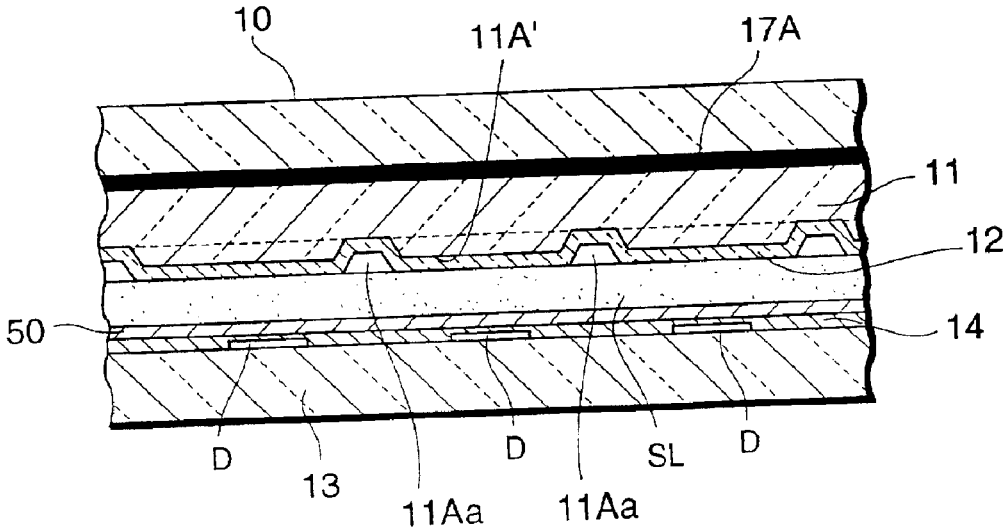
FIG. 22 is a section view taken along the W7—W7 line of FIG. 18.
Figure 23:
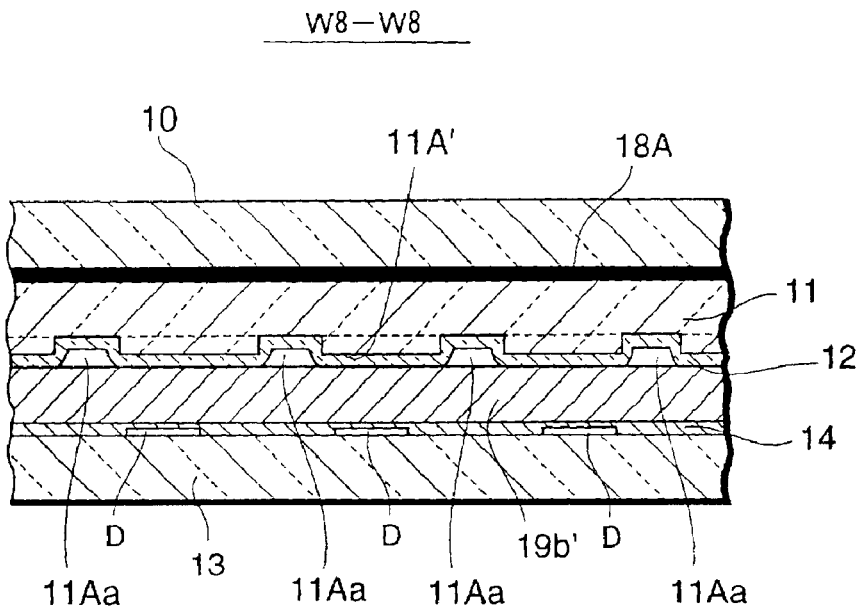
FIG. 23 is a section view taken along the W8—W8 line of FIG. 18.

FIGS. 18 to 23 illustrate a fifth example of the embodiment of the PDP according to the present invention. FIG. 18 is a front view schematically illustrating the PDP in the fifth example. FIG. 19 is a section view taken along the V5—V5 line in FIG. 18. FIG. 20 is a section view taken along the V6—V6 line in FIG. 18. FIG. 21 is a section view taken along the W6—W6 line in FIG. 18. FIG. 22 is a section view taken along the W7—W7 line in FIG. 18. FIG. 23 is a section view taken along the W8—W8 line in FIG. 18.

The PDP illustrated in FIGS. 18 to 23 is configured such that a plurality of row electrode pairs (X, Y) are disposed on the back face of a front glass substrate 10 serving as the display surface and extends in parallel to each other in the row direction of the front glass substrate 10 (in the right-left direction of FIG. 18).

The row electrode X is made up of transparent electrodes Xa formed in a T-like shape of a transparent conductive film made of ITO or the like, and a bus electrode Xb which is formed of a metal film extending in the row direction of the front glass substrate 10 and connects to a narrowed proximal end of each transparent electrode Xa.

Likewise, the row electrode Y made up of transparent electrodes Ya formed in a T-like shape of a transparent conductive film made of ITO or the like, and a bus electrode Yb which is formed of a metal film extending in the row direction of the front glass substrate 10 and connects to a narrowed proximal end of each transparent electrode Ya.

The row electrodes X and Y are alternately arranged in a column direction of the front glass substrate 10 (in the vertical direction in FIG. 18). The transparent electrodes Xa and Ya disposed along the respective bus electrodes Xb and Yb extend toward the other row electrode as the pair to each other such that the top sides of the widened portions of the transparent electrodes Xa and Ya oppose each other on the opposite sides of a discharge gap g having a predetermined width.

Each of the bus electrodes Xb, Yb is formed in a double-layer structure with a black conductive layer Xb', Yb' on the display surface side and a main conductive layer Xb", Yb" on the back substrate side.

On the back face of the front glass substrate 10 and between the back-to-back bus electrodes Xb and Yb of the respective row electrode pairs (X, Y) adjacent to each other in the column direction, a black light absorption layer (light-shield layer) 18A extends along the bus electrodes Xb, Yb in the row direction. Additionally, a light absorption layer (light-shield layer) 18B is provided at a position opposing a vertical wall 19*a* of a partition wall 19 described later.

On the back face of the front glass substrate 10, further, a dielectric layer 11 overlays the row electrode pairs (X, Y). On the back face of the dielectric layer 11, an additional dielectric layer 11A' juts out of the back face of the dielectric layer 11 at a position opposing adjacent bus electrodes Xb and Yb of the respective row electrode pairs (X, Y) adjacent to each other, and opposing an area between the adjacent bus electrodes Xb and Yb. The additional dielectric layer 11A' extends in parallel to the bus electrodes Xb, Yb.

On the back faces of the dielectric layer 11 and the additional dielectric layers 11A', a protective layer 12 made of MgO is formed.

Next, a back glass substrate 13 is disposed in parallel to the front glass substrate 10. On the front face of the back glass substrate 13 on the display surface side, column electrodes D are arranged in parallel at regularly established intervals from each other, and extend in the direction perpendicular to the row electrode pairs (X, Y) (in the column direction) at sites opposing the paired transparent electrodes Xa and Ya of each row electrode pair (X, Y).

A white dielectric layer 14 overlaying the column electrodes D is further provided on the front face of the back glass substrate 13 on the display surface side, and the partition wall 19 is provided on the dielectric layer 14.

The partition wall 19 is formed in a ladder pattern by vertical walls 19*a* extending in the column direction between the adjacent column electrodes D disposed in parallel to each other, and transverse walls 19*b* extending in the row direction at locations opposing the additional dielectric layers 11A'. The ladder-patterned partition walls 19 define a discharge space S between the front glass substrate 10 and the back glass substrate 13 into each area facing the paired transparent electrodes Xa and Ya of each row electrode pair (X, Y) to form quadrangular discharge cells C.

The transverse wall 19*b* of the partition wall 19 defining the discharge space S is divided in the column direction by the interstice SL provided at a position overlapping the light absorption layer 18A between the display lines.

In other words, the partition walls 19 each formed in a ladder pattern along the direction of the display line (row) L, and are arranged in the column direction and parallel to each other with the interposition of the interstices SL extending along the display line L.

A width of the interstice SL is set such that each of portions 19*b*' of the transverse wall 19*b* divided by the interstice SL provided between the adjacent display lines L has a width approximately equal to the width of each vertical wall 19*a*.

On the five faces of a front face of the dielectric layer 14 and side faces of the vertical walls 19*a* and transverse walls 19*b* of the partition wall 19 which face the discharge space S, a phosphor layer 16 overlays all the five faces in each discharge space S. The phosphor layers 16 are set in order of red (R), green (G), blue (B) for the sequence of discharge spaces S in the row direction (see FIG. 21).

The discharge cell C is filled with a discharge gas including a mixed inert gas containing 10% or more of a xenon gas.

The protective layer 12 overlaying the additional dielectric layer 11A' is in contact with the face of the transverse wall 19*b*' of the partition wall 19 on the display surface side (see FIG. 22), and hence the additional dielectric layer 11A' blocks the adjacent discharge cells C in the column direction from each other. The additional dielectric layer 11A' is provided with a groove 11Aa at each position in alignment with the vertical wall 19*a* of the partition wall 19 in FIG. 18. The groove 11Aa extends in the column direction and has both end open at the walls of the additional dielectric layer 11A' in the vertical direction thereof, and the back face free (see FIGS. 22 and 23). Each discharge cell C communicates through the groove 11Aa with the interstice SL which is situated between the transverse walls 19*b*' of the partition wall 19 arranged in the column direction.

The face of the vertical wall 19*a* of the partition wall 19 on the display surface side is out of contact with the protective layer 12 (see FIG. 21). A clearance r is provided between the vertical wall 19*a* and the protective layer 12 to establish communication between the adjacent discharge cells C in the row direction therethrough.

In the interstice SL provided between the transverse walls 19*b*' of the partition wall 19, a priming particle generating layer (priming particle generating member) 50 is provided to overlay the inner wall-face of the interstice SL.

The priming particle generating layer 50 is formed of an ultraviolet region light emissive material or a visible region light emissive material having the persistence characteristics giving emission for 0.1 msec or more by way of example.

The priming particle generating layer 50 made of the ultraviolet region or the visible region light emissive material may contain a material (a high γ material) having a higher coefficient of secondary electron emission (a small work function) than that of dielectrics (MgO) forming the protective layer 12 or a coefficient of secondary electron emission equal to the same, or a material having a work function of 4.2V or less.

Examples of materials having a small work function and insulation properties include oxides of alkali metals (e.g. $Cs_2O$: work function 2.3 eV), oxides of alkali-earth metals (e.g. CaO, SrO, BaO), fluorides ($CaF_2$, $MgF_2$), a material of which a coefficient of secondary electron emission is increased as a result of introduction of impurity level into crystals caused by crystal defects or impurities (e.g. MgOx having a composition ratio of Mg:O changed from 1:1 to introduce crystal defects), $TiO_2$, $Y_2O_3$, and so on.

The ultraviolet region light emissive material has the persistence characteristics allowing continuous radiation of ultraviolet light for 0.1 msec or more, preferably, 1 msec or more (i.e. length of time of the addressing period Wc or more) resulting from excitation by 147 nm-wavelength vacuum ultraviolet rays radiated by a discharge from xenon Xe included in the discharge gas. Examples of such ultraviolet region light emissive material include $BaSi_2O_5:Pb^{2+}$ (a wavelength of emitted light: 350 nm), $SrB_4O_7F:Eu^{2+}$ (wavelength of emitted light: 360 nm), $(Ba, Mg, Zn)_3Si_2O_7:Pb^{2+}$ (wavelength of emitted light: 295 nm), $YF_3$:Gd, Pr, and so on.

The visible region light emissive material has the persistence characteristics allowing radiation of ultraviolet light for 0.1 msec or more, preferably, 1 msec or more, resulting from excitation by 147 nm-wavelength vacuum ultraviolet rays radiated by the discharge from xenon Xe included in the discharge gas. Example of such visible region light emissive material includes a phosphor material such as red (Y,Gd) $BO_3$:Eu and green $Zn_2SiO_4$:Mn.

Images in the PDP are generated as in the first example and the like as described hereinbefore.

In the PDP, the discharge gas is filled into or removed from each discharge cell through the clearance r which is provided between the face of the vertical wall 19*a* of the partition wall 19 on the display surface side and the protective layer 12 overlaying the dielectric layer 11. Moreover, due to the clearance r, the priming effect of propagation of triggers of the discharge between the adjacent discharge cells C in the row direction is ensured.

The additional dielectric layer 11A' blocks communication between the adjacent discharge cells C in the column direction in order to prevent the discharge for generating an image from spreading into an adjacent discharge cell in the column direction to produce a false discharge. However, each discharge cell C communicates with the interstice SL, provided in the transverse wall 19, through the groove 11Aa provided in the additional dielectric layer 11A'. For this reason, the priming particles (pilot flame) is introduced from the interstice SL into an adjacent discharge cell in the column direction via the groove 11Aa, resulting in ensuring the priming effect in the column direction as in that in the row direction.

Specifically, driving pulses (reset pulses RPx, RPy applied to the column electrode D and the row electrode X or Y in the reset operation in FIG. 40; scan pulses SP applied to one of the row electrodes X, Y in the addressing operation; and display data pulses $DP_{1-n}$ applied to the column electrode D) are applied between the column electrode D and the row electrode X or Y for producing the reset discharge (a discharge for temporarily forming wall charge in all the discharge cells C) in the reset operation, and the selective discharge (a discharge for selectively erasing the wall charge formed by the reset discharge in response to the display image data) in the addressing operation. At this time, since the production of the discharge is facilitated because of the short discharge distance between the column electrode D and the row electrodes X, Y in the region where the additional dielectric layer 11A' is provided, the discharge is produced between the column electrode D and the row electrodes X, Y in the interstice SL.

The priming particles (pilot flame) is generated in the interstice SL by the discharge, and then spread through the groove 11Aa into an adjacent discharge cell C in the column direction. This produces the priming effect of inducing the discharge between the adjacent discharge cells C.

The 147 nm-wavelength vacuum ultraviolet rays radiated from xenon included in the discharge gas in the reset discharge, are guided through the groove 11Aa into the interstice SL, and then excite the priming particle generating layer 50 which is made of the ultraviolet region or the visible region light emissive material and provided in the interstice SL, to cause the priming particle generating layer 50 to radiate ultraviolet light or visible light. In turn, the ultraviolet light or visible light excites the protective layer (MgO layer) 12 for emission of the priming particles.

When the ultraviolet region or the visible region light emissive material forming the priming particle generating layer 50 contains a material having a work function smaller than or approximately equal to that of dielectrics (MgO) (a material having a work function of 4.2V or less), the 147 nm-wavelength vacuum ultraviolet rays radiated from the 10% or more xenon included in the discharge gas in the reset discharge are guided via the groove 11Aa into the interstice SL, and excite the priming particle generating layer 50 for radiation of ultraviolet light or visible light. The radiated ultraviolet light or visible light excites the protective layer (MgO layer) 12 and the high γ material contained in the priming particle generating layer 50 for emission of the priming particles.

In this way, due to the persistence characteristics of the ultraviolet region light emissive material or the visible region light emissive material forming the priming particle generating layer 50 and situated in the interstice SL, ultraviolet light or visible light is continuously radiated for at least 0.1 msec or more. In consequence, the amount of priming particles in the addressing period Wc following the concurrent reset period Rc (see FIG. 40) is sufficiently ensured.

In the fifth example, a mixed inert gas containing 10% or more of a xenon gas is used as the discharge gas. By increasing partial pressure of the xenon gas, the amount of vacuum ultraviolet rays radiated from the xenon increases, resulting in an increase in emission efficiency. Provision of the priming particle generating layer 50 containing the ultraviolet region light emissive material inhibits an extension of delay time of the selective discharge caused by an increase of a discharge voltage with an increase in partial pressure of the xenon gas.

The foregoing shows an example in which the groove making communication between the discharge space in the discharge cell C and the discharge space in the interstice SL is provided in the additional dielectric layer 11A', but the present invention is not limited to this. The groove may be provided in the transverse wall of the partition wall to communicate between the discharge space in the discharge cell C and the discharge space in the interstice SL.

Further, in the fifth example, the black or dark brown light absorption layer 18A is provided in the area sandwiched by the bus electrodes Xb and Yb which serve as a non-display line, and the bus electrodes Xb and Yb include the respective black conductor layers Xb', Yb' on the display surface side. For this reason, the reflection of ambient light on the non-display lines is prevented to enhance contrast. In addition, when the discharge for the priming is produced between the column electrode D and the row electrode X, Y in the interstice SL, the resulting light may not adversely affect the contrast on images.

Next, a sixth example in the embodiment according to the present invention will be described with reference to FIG. 24 to FIG. 29.

Figure 24:
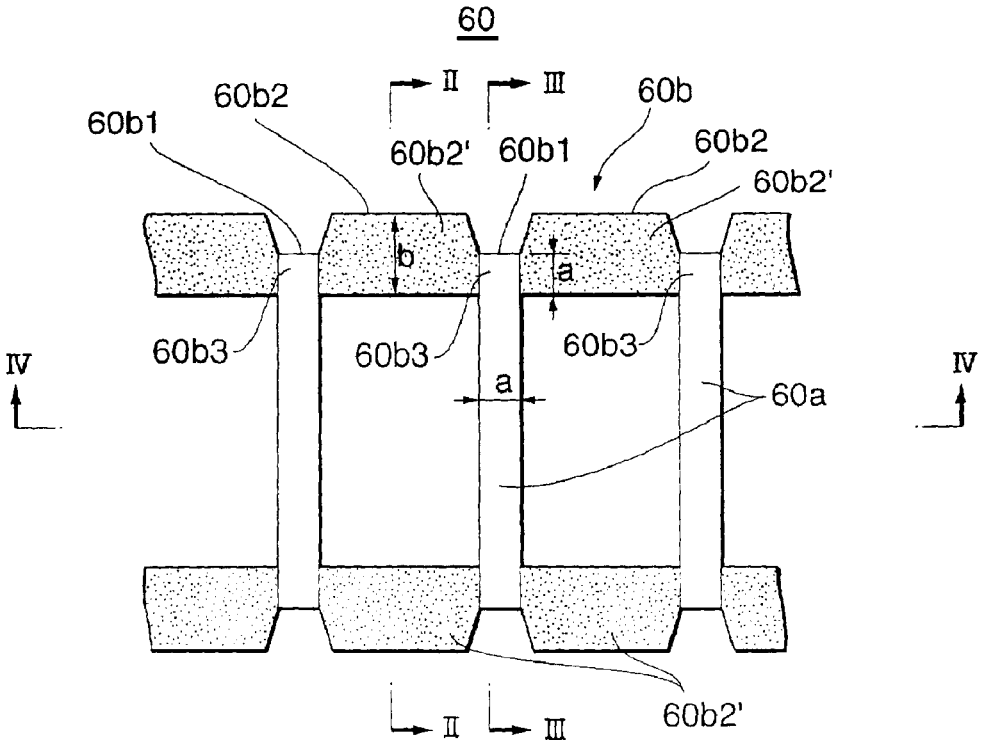
FIG. 24 is a front view illustrating partition wall of a sixth example according to the present invention.
Figure 25A:
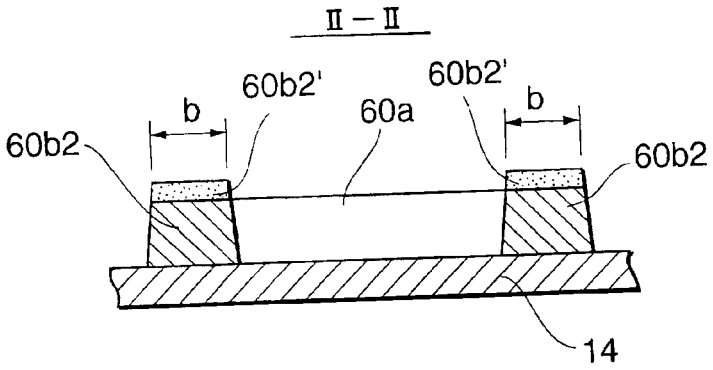
FIG. 25A is a section view taken along the II—II line of FIG. 24.
Figure 25B:
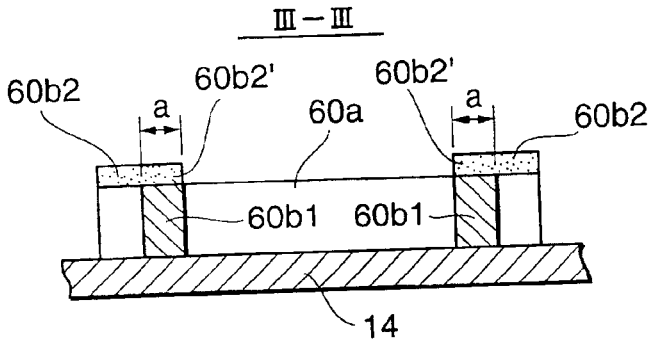
FIG. 25B is a section view taken along the III—III line of FIG. 24.
Figure 26:
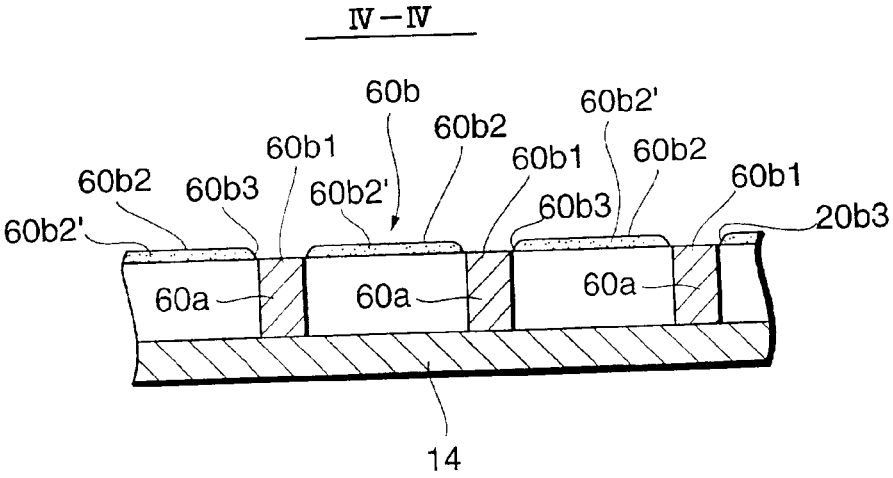
FIG. 26 is a section view taken along the IV—IV line of FIG. 24.

FIGS. 24 to 26 illustrate a partition wall structure in the PDP of the sixth example. FIG. 24 is a front view of a partition wall in the sixth example. FIG. 25A is a vertical section view taken along the II—II line of FIG. 24. FIG. 25B is a vertical section view taken along the III—III line of FIG. 24. FIG. 26 is a horizontal section view taken along the IV—IV line of FIG. 24.

Figure 27:
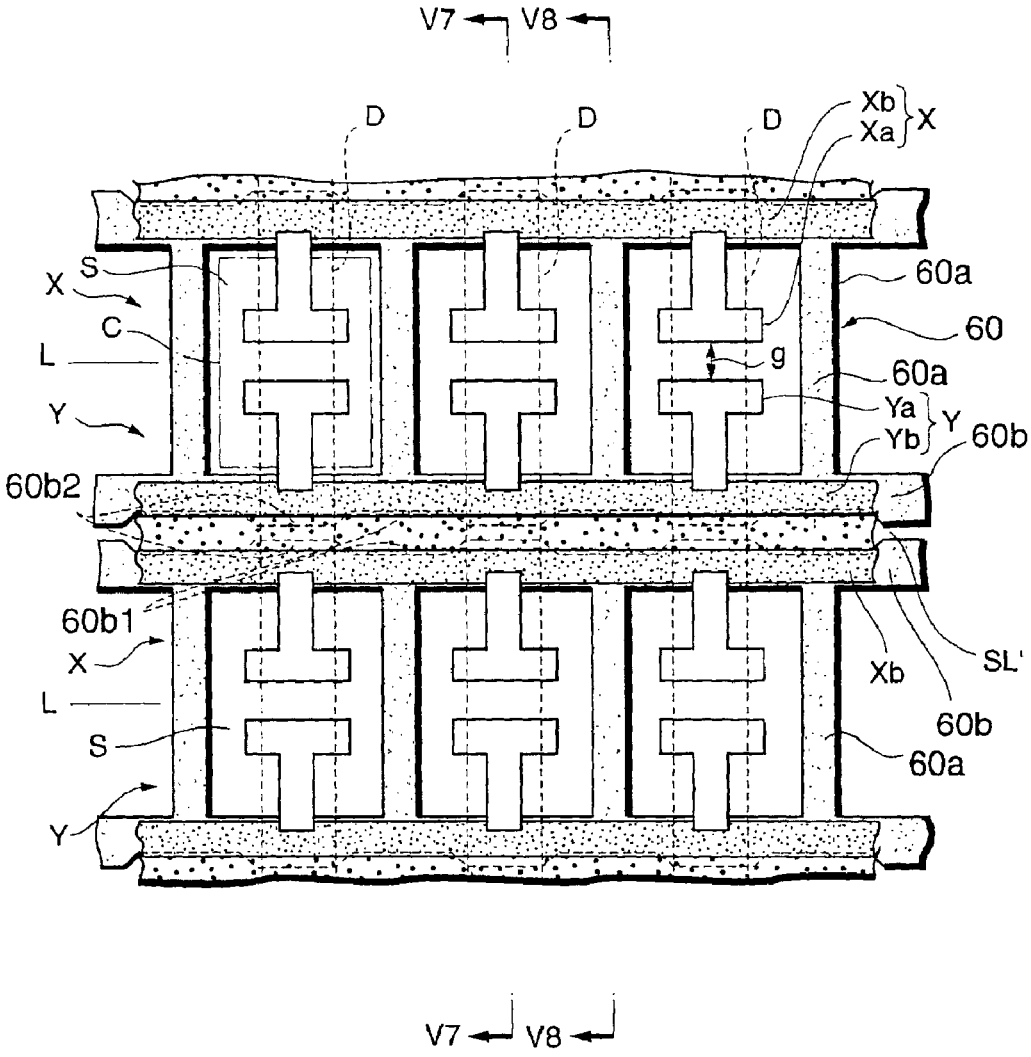
FIG. 27 is a front view schematically illustrating the PDP of the sixth example.
Figure 28:
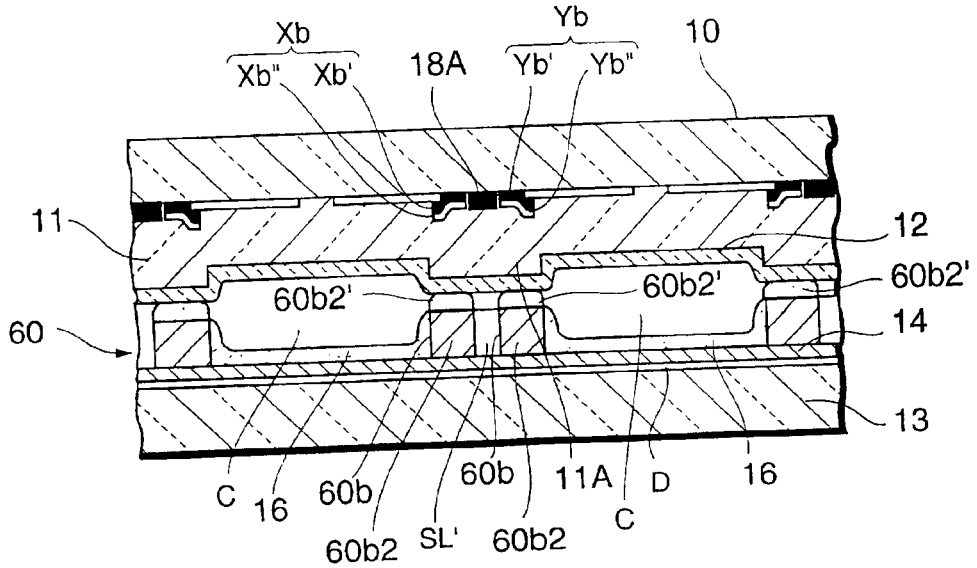
FIG. 28 is a section view taken along the V7—V7 line of FIG. 27.
Figure 29:
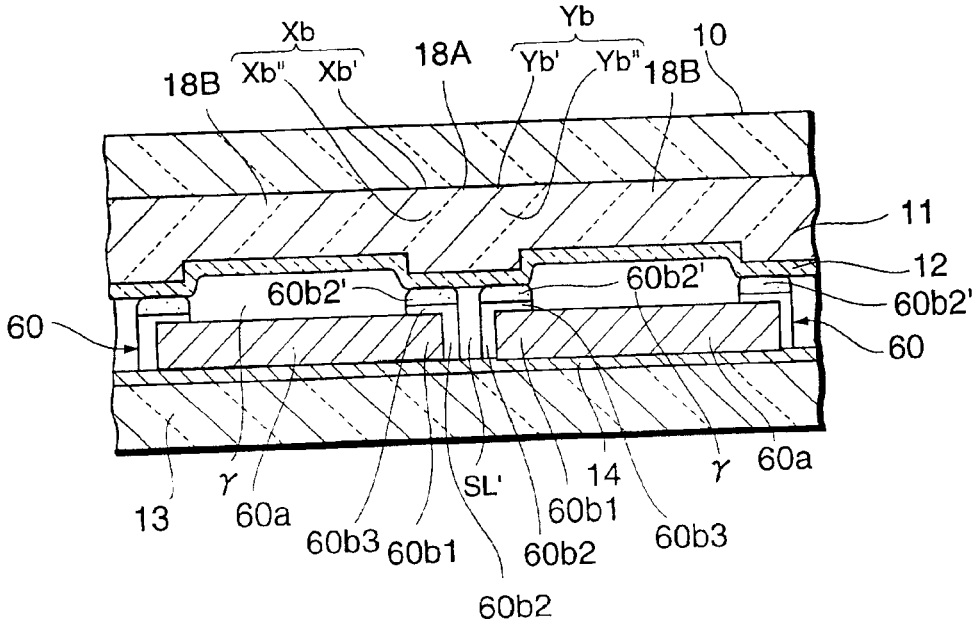
FIG. 29 is a section view taken along the V8—V8 line of FIG. 27.

Further, FIG. 27 is a front view schematically showing the PDP in the sixth example. FIG. 28 is a section view taken along the V7—V7 line in FIG. 27. FIG. 29 is a section view-taken along the V8—V8 line in FIG. 27.

A partition wall 60 in the sixth example is formed in a so-called ladder pattern by a plurality of vertical walls 60*a* which are arranged in parallel with each other at regular intervals and extend in the vertical direction, and a pair of transverse walls 60*b* which are respectively spanned in the horizontal direction across the top ends and the bottom ends of the vertical walls 60*a*.

Each transverse wall 60*b* of the partition wall 60 is formed such that a width a of a portion of the transverse wall 60*b* facing the top end or the bottom end of the corresponding vertical wall 60*a* (i.e. a coupling portion 60*b*1 of the transverse wall 60*b* to the vertical wall 60*a*) is equal to a width of the vertical wall 60*a*, and that a vertical direction width b of a portion thereof situated between the top ends or between the bottom ends of the two vertical walls 60*a* (i.e. a spanning portion 60*b*2 between the adjacent vertical walls 60*a*), is larger than the width a of the coupling portion 60*b*1.

In FIGS. 25A, 25B and 26, reference numeral 14 represents a dielectric layer provided on the back glass substrate.

For the partition wall 60, a glass material layer having a required thickness is formed on the dielectric layer 14, then undergoes the sandblast process to be cut through a mask having a predetermined pattern. After that, the patterned glass material layer is burned for forming the partition wall 60.

In this event, since each transverse wall 60*b* has the shape that the width a of the coupling portion 60*b*1 is smaller than the width b of the spanning portion 60*b*2, the spanning portion 60*b*2 provides durability to the transverse wall 60*b* to withstand a tensile force caused by the shrinkage of the vertical walls 60*a* during the burning. This prevents one side of the transverse wall 60*b* opposing the other side thereof supported by the dielectric layer 14 from being drawn by the tensile force caused by the shrinkage of the vertical walls 60*a* during the burning and inclining inward.

Further, the transverse wall 60*b* is formed such that the width a at the coupling portion 60*b*1 is equal to the width of the vertical wall 60*a*. This provides an easing of the internal tensile stress produced in the vertical wall 60*a* by the shrinkage during the burning, resulting in preventing the vertical wall 60*a* from cutting.

Furthermore, the difference in size between the width a of the coupling portion 60*b*1 and the width b of the spanning portion 60*b*2 in the transverse wall 60*b* produces a difference of shrinkage in the thickness directions of the coupling portion 60*b*1 and the spanning portion 60*b*2. Hence, as illustrated in FIG. 26, the thickness of the coupling portion 60*b*1 of the transverse wall 60*b* becomes smaller than the thickness of the spanning portion 60*b*2 with a larger width, and thus a groove 60*b*3 is formed on the coupling portion 60*b*1 and between the adjacent spanning portions 60*b*2.

At this point, on the front face of the spanning portion 60*b*2 (the top side of FIGS. 25A and 25B), is formed a priming particle generating layer (priming particle generating member) 60*b*2' which is made of an ultraviolet region light emissive material or a visible region light emissive material having the persistence characteristics allowing emission for 0.1 msec or more as in the fifth example by way of example. Therefore, a portion of the spanning portion 60*b*2 jutting further forward than the front face of the coupling portion 60*b*1 is constructed by the priming particle generating layer 60*b*2'.

The priming particle generating layer 60*b*2' may contain a material (a high γ material) having a coefficient of secondary electron emission higher (a small work function) than that of dielectrics (MgO) forming the protective layer 12 or a coefficient of secondary electron emission equal to the same, or a material having a work function of 4.2V or less.

Examples of materials having a small work function and insulation properties can be given similar to those described in the fifth example.

The groove 60*b*3 and the priming particle generating layer 60*b*2' provided on the transverse wall 60*b* of the partition wall 60 make sure of the priming effect of inducing a discharge between the discharge cells arranged in the column direction of the PDP as described in the following.

Specifically, as illustrated in FIGS. 27 to 29, a plurality of the aforementioned partition walls 60 are arranged in the column direction on the dielectric layer 14 with being spaced from each other at predetermined intervals by interstices SL' each extending in the row direction as in the PDP of the fifth example. Such ladder-patterned partition wall 60 defines a discharge space S between the front glass substrate 10 and the back glass substrate 13 into the discharge cells C in each area facing the paired transparent electrodes Xa and Ya in each row electrode pair (X, Y).

The remaining configuration of the PDP illustrated in FIGS. 27 to 29 is the same as that of the PDP in the fifth example and the same reference numerals are attached.

As seen from FIG. 28, in the PDP, the transverse wall 60*b* of the partition wall 60 is in contact with the protective layer 12 overlaying the additional dielectric layer 11A at the face of its spanning 60*b*2 with a larger thickness on the display surface side (the upper face in FIG. 28). Therefore, the discharge cell C is blocked from the interstice SL'. However, as is clear from FIG. 29, the face of the coupling portion 60*b*1 of the transverse wall 60*b* on the display surface side (the upper face in FIG. 29) is out of contact with the protective layer 12 overlaying the additional dielectric layer 11A. Therefore, the discharge cell C communicates with the interstices SL' adjacent thereto via the groove 60*b*3 provided on the face of the coupling portion 60*b*1 on the display surface side.

With the configuration, driving pulses (reset pulses applied to the column electrode D and the row electrode X or Y in the reset operation; scan pulses applied to one of the row electrodes X, Y in the addressing operation; and display data pulses applied to the column electrode D) are applied between the column electrode D and the row electrode X or Y for producing a reset discharge in the reset operation, and a selecting discharge in the addressing operation.

At this time, since the production of the discharge is facilitated because of the short discharge distance between the column electrode D and the row electrodes X, Y in the region where the additional dielectric layer 11A is provided, the discharge is produced between the column electrode D and the row electrodes X, Y in the interstice SL'. The priming particles (pilot flame) generated by the discharge in the interstice SL' is spread via the groove 60*b*3 into the discharge cells C adjacent to the interstice SL' in the column direction, resulting in the priming effect of inducing the discharge between the adjacent discharge cells C.

Further, in the reset discharge, the 147 nm-wavelength vacuum ultraviolet rays radiated from the 10% or more xenon included in a discharge gas excite the priming particle generating layer 60*b*2' provided on the spanning portion 60*b*2 to cause the priming particle generating layer 60*b*2' to radiate ultraviolet light or visible light. In turn, the ultraviolet light or visible light excites the protective layer (MgO layer) 12 to cause it to emit secondary electrons (priming particles).

In the case where the ultraviolet region light emissive material or the visible region light emissive material making up the priming particle generating layer 60*b*2' contains a material having a smaller work function than that of dielectrics (MgO) (a material having 4.2 V or less of a work function), the 147 nm-wavelength vacuum ultraviolet rays radiated from the xenon included in the discharge gas in the reset discharge is guided via the groove 60*b*3 into the interstice SL' and excites the priming particle generating layer 60*b*2' to cause it to radiate ultraviolet light or visible light. The radiated ultraviolet light or visible light excites the protective layer (MgO layer) 12 and the high γ material contained in the priming particle generating layer 60*b*2' to cause them to emit secondary electrons (priming particles).

In this way, due to the persistence characteristics of the ultraviolet region light emissive material or the visible region light emissive material making up the priming particle generating layer 60*b*2', the ultraviolet light or the visible light is continuously radiated for at least 0.1 msec or more. For this reason, the amount of priming particles in the addressing period Wc following the concurrent reset period Rc (see FIG. 40) is sufficiently ensured.

Figure 30:
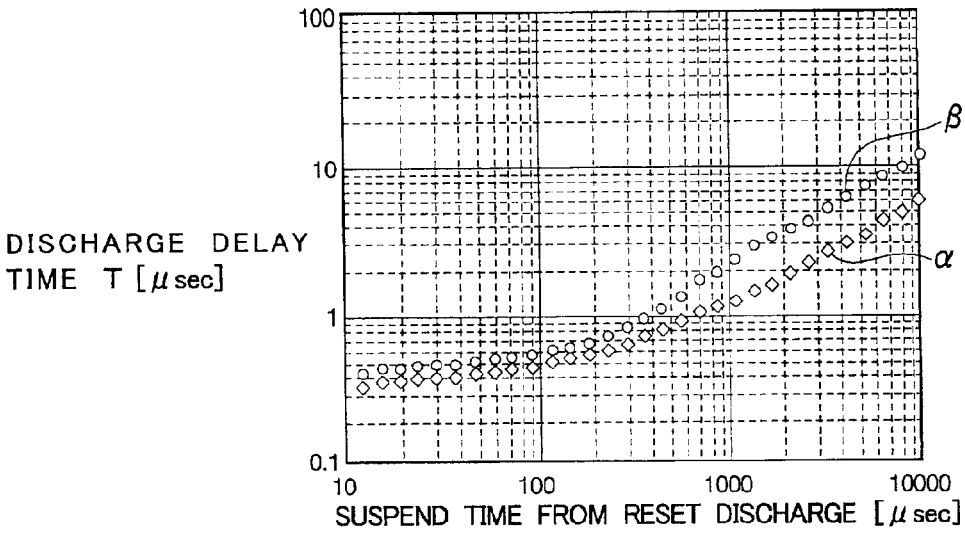
FIG. 30 is a graph illustrating a relationship between discharge suspended time and discharge delay time from the concurrent reset discharge to the selective discharge.
Figure 31:
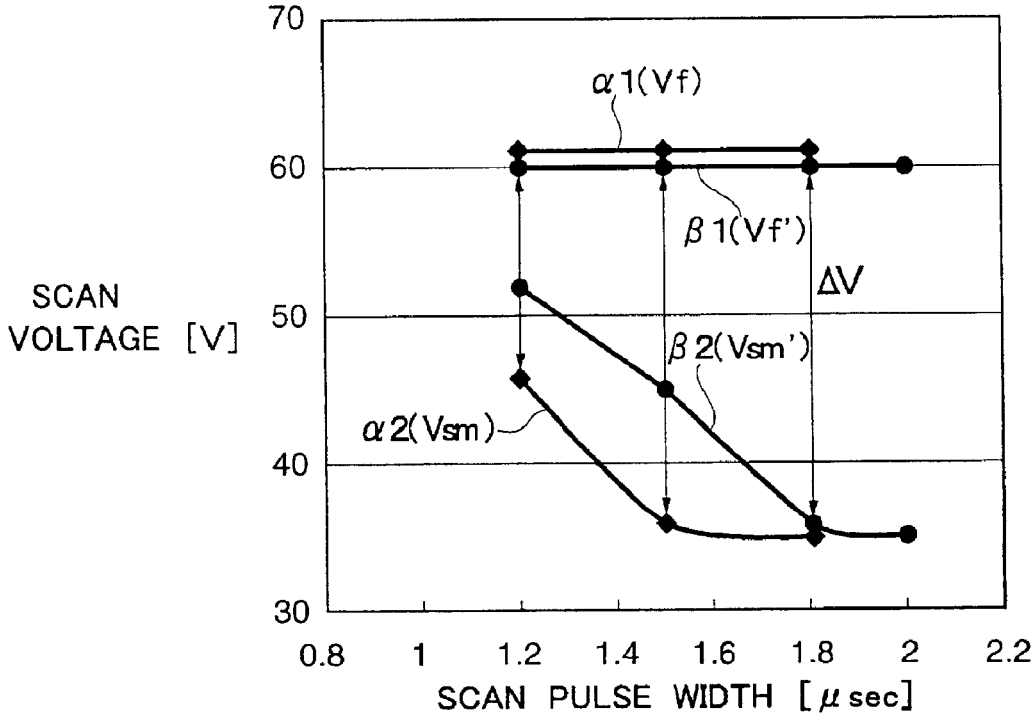
FIG. 31 is a graph illustrating a relationship between scan pulse widths and scan voltages.

FIGS. 30 and 31 are graphs for showing the priming effect when the priming particle generating layer 60*b*2' contains the ultraviolet region light emissive material which is UV phosphor (Ba, Mg, Zn)$_3$Si$_2$O$_7$:Pb$^{2+}$ (wavelength of emitted light: 295 nm) having the persistence characteristics and containing 10 to 20 wt % of a material having a small work function (MgO), in the sixth example.

FIG. 30 shows data on a relationship between the discharge suspended time and the discharge delay time from the concurrent rest discharge to the selective discharge, in comparison of the case where the priming particle generating layer 60*b*2' is provided and the case where the priming particle generating layer 60*b*2' is not provided.

In FIG. 30, line α represents the case where the priming particle generating layer 60*b*2' is provided, and line β represents the case where the priming particle generating layer 60*b*2' is not provided.

As described earlier, since the data is read in a sequence of lines during the addressing period, the display line L finally scanned has a discharge delay time because of the time elapsed from the concurrent reset discharge, in comparison with the display line L initially scanned by the scan pulses. Therefore, assuming that a pulse width of a scan pulse is approximately 2 μsec and the number of scan lines is approximately 400, a time of approximately 1 msec is required for scanning all the display lines to read the data during the address period.

This is because the amount of priming particles decreases with the passage of time from the concurrent reset discharge and it becomes harder for the discharge to be induced, which leads to degradation in discharge probability and an extension of the discharge delay time from the application of the scan pulses and the data pulses to the initiation of the discharge.

Referring to FIG. 30, it is seen that from a comparison of line α where the priming particle generating layer 60*b*2' is provided with line β where the priming particle generating layer 60*b*2' is not provided, the degradation in discharge probability and the extension of the discharge delay time associated with such decrease of the amount of priming particles is significantly improved.

FIG. 31 shows data on the width of the scan pulse and the voltage of the scan pulse (a scan voltage) from a comparison of the case where the priming particle generating layer 60*b*2' is provided and the case where it is not provided.

In FIG. 31, line α1 represents discharge starting voltage (a voltage when a discharge is not initiated immediately before and priming particles are not generated) Vf in the case where the priming particle generating layer 60*b*2' is provided, and line α2 represents discharge sustaining minimum voltage (a voltage when a discharge has been initiated immediately before then and priming particles are generated) Vsm.

Line β1 represents discharge starting voltage Vf' in the case where the priming particle generating layer 60*b*2' is not provided, and line β2 represents discharge sustaining minimum voltage Vsm'.

It is seen from FIG. 31 that by the provision of the priming particle generating layer 60*b*2', even when a width of the scan pulse is set to be small, an address margin (a difference between the discharge starting voltage Vf, Vf' and the discharge sustaining minimum voltage Vsm, Vsm') ΔV can be obtained at a value approximately equal to that of an address margin ΔV in the case where a width of the scan pulse is set to be large when the priming particle generating layer 60*b*2' is not provided.

As the address margin is larger, an occasion of a false discharge is less. This allows achievement of fast-addressability and improvement of display quality.

In the foregoing, the mixed inert gas containing 10% or more of a xenon gas is used as the discharge gas, and by increasing the partial pressure of the xenon gas, the amount of vacuum ultraviolet rays radiated from the xenon increases and thus the efficiency of light emission increases. However, as the partial pressure of the xenon gas increases, the discharge voltage increases and the discharge delay time is longer. The provision of the priming particle generating layer 60*b*2' containing the ultraviolet region light emissive material inhibits an extension of the discharge display time which is caused in association with the use of a discharge gas containing 10% or more of a xenon gas.

In the sixth example, the black or dark brown light shield layer 18A is provided in the area between the bus electrodes Xb and Yb serving as the non-display line. Further, the faces of the bus electrodes Xb and Yb on the display surface side are made up of the respective black conductive layers Xb', Yb'. For these reasons, the reflection of ambient light is prevented and contrast is improved. In addition, even when the discharge for priming is caused between the column electrode D and the row electrode X, Y in the interstice SL', the resulting light may not adversely affect contrast on images.

As seen from FIG. 29, in the PDP, the vertical wall 60*a* is opposite to a portion of the dielectric layer 11 without the additional dielectric layer 11A, and out of contact with the protective layer 12. Therefore, since the adjacent discharge cells C in the row direction are communicated with each other through the clearance r provided between the vertical wall 60 and the protective layer 12, the priming particles spread via the clearance r in the row direction, resulting in ensuring the priming effect in the row direction.

Further, the sixth example describes about the example in which the priming particle generating layer is disposed on the front face of the spanning portion 60*b*2 (the portion of the transverse wall situated at a higher level than the vertical wall). However, the priming particle generating layer may be disposed in the groove 60*b*3 sandwiched between the spanning portions 60*b*2.

Figure 32:
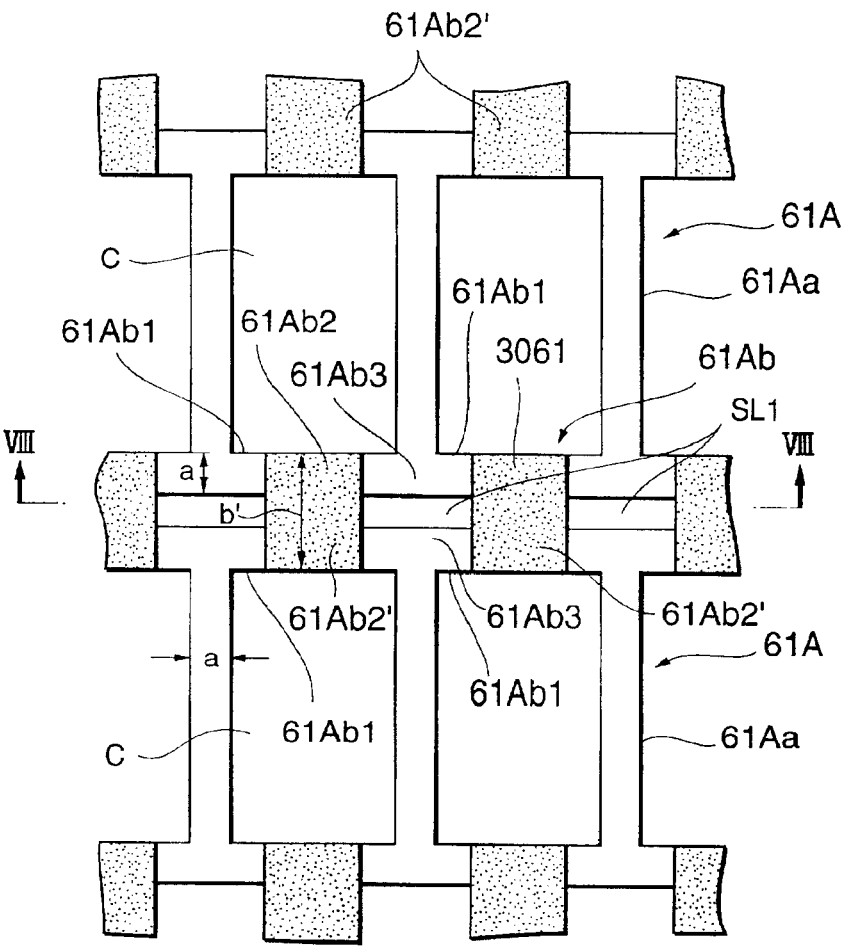
FIG. 32 is a front view illustrating another example of partition wall structure of the sixth example.
Figure 33:
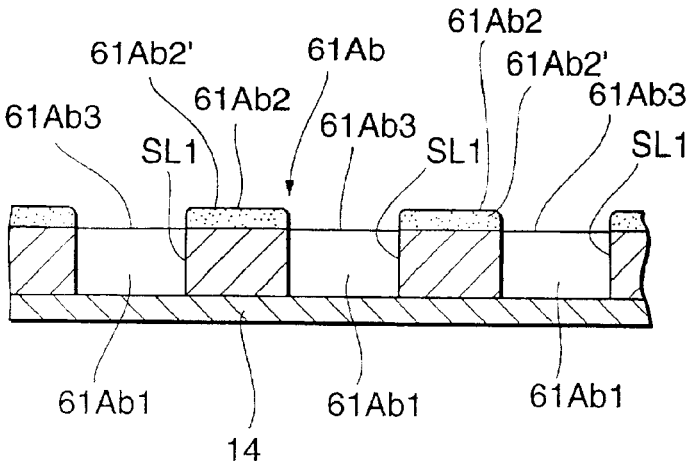
FIG. 33 is a section view taken along the VIII—VIII line of FIG. 32.

FIGS. 32 and 33 are a front view and a section view illustrating another example of the partition wall structure of the PDP in the sixth example.

In FIG. 32, a partition wall 61 includes wall portions 61A defining the discharge cells in each row of the PDP. Each of the wall portions 61A is formed in a ladder pattern by vertical walls 61Aa and a pair of transverse wall 61Ab spanned in the horizontal direction as in the case of the aforementioned partition wall 60. The wall portions 61A are arranged in parallel in the column direction with interposing an interstice SL1 having a predetermined width.

In the partition wall 61, the adjacent wall portions 61A in the column direction are integrated by being coupled to each other at the respective portions situated between the top ends and between the bottom ends of the respective and adjacent vertical walls 61Aa. A width b' of a spanning portion 61Ab2 is larger than a width a of a coupling portion 61Ab1 (a portion facing the top end or the bottom end of the vertical wall 61Aa) of the transverse wall 61Ab of the wall portion 61A, the width a being set to be equal to a width of the vertical wall 61Aa.

As in the case of the aforementioned partition wall 60, in the partition wall 61, the spanning portion 61Ab2 of each wall portion 61A provides durability to the transverse wall 61Ab to withstand a tensile force caused by the shrinkage of the vertical walls 61Aa during the burning. This prevents the transverse wall 61Ab from being drawn by the tensile force caused by the shrinkage of the vertical walls 61Aa during the burning to deform. Further, the width a of the coupling portion 61Ab1 of the transverse wall 61Ab is equal to the width of the vertical wall 61Aa. This provides an easing of the internal tensile stress produced in the vertical wall 61Aa by the shrinkage during the burning, resulting in preventing the vertical wall 61Aa from cutting.

Furthermore, the difference in size between the width a of the coupling portion 61Ab1 and the width b' of the spanning portion 61Ab2 in the transverse wall 61Ab produces a difference of shrinkage in the thickness directions of the coupling portion 61Ab1 and the spanning portion 61Ab2. Hence, as illustrated in FIG. 33, the thickness of the coupling portion 61Ab1 of the transverse wall 61Ab becomes smaller than the thickness of the spanning portion 61Ab2 with a larger width, and thus a groove 61Ab3 interposed between the spanning portions 61Ab2 is formed on the coupling portion 61Ab1. Accordingly, as in the case of the aforementioned partition wall 60, in the PDP with such partition wall 61, the priming particles (pilot flame) generated in the interstice SL1 by the discharge spread via the groove 61Ab3 into the discharge cells C adjacent thereto in the column direction, to produce the priming effect of triggering the discharge between the adjacent discharge cells C.

As in the case of the aforementioned partition wall 60, in the above partition wall 61, a portion of the spanning portion 61Ab2 jutting further forward (upward in FIG. 33) than the front face of the coupling portion 61Ab1 is constructed by a priming particle generating layer (priming particle generating member) 61Ab2' made of the ultraviolet region light emissive material or the visible region light emissive material. Hence, in the reset discharge, 147 nm-wavelength vacuum ultraviolet rays radiated from xenon included in the discharge gas, excites the priming particle generating layer 61Ab2' to cause it to radiate ultraviolet light or visible light. Then, the resulting ultraviolet light or visible light excites the protective layer (MgO layer), and also a high γ material if it is contained in the priming particle generating layer 61Ab2', to allow emission of priming particles.

As described above, due to the persistence characteristics of the ultraviolet region light emissive material or the visible region light emissive material making up the priming particle generating layer 61Ab2', the ultraviolet light or visible light is continuously radiated for at least 0.1 msec or more, resulting in sufficiently ensuring the amount of priming particles in the addressing period Wc following the concurrent reset period Rc (see FIG. 40).

Figure 35:
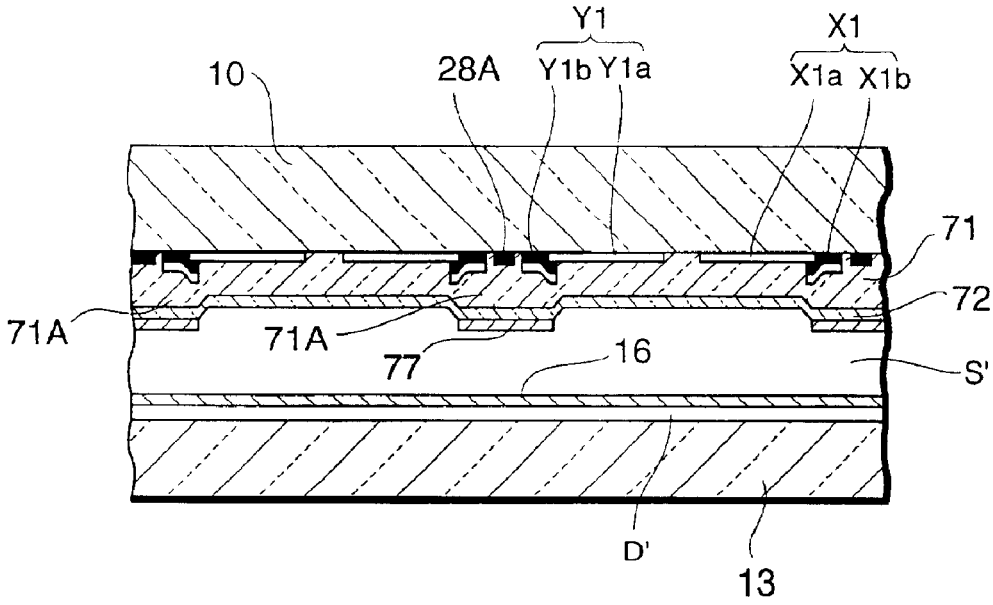
FIG. 35 is a section view taken along the V9—V9 line of FIG. 34.
Figure 36:
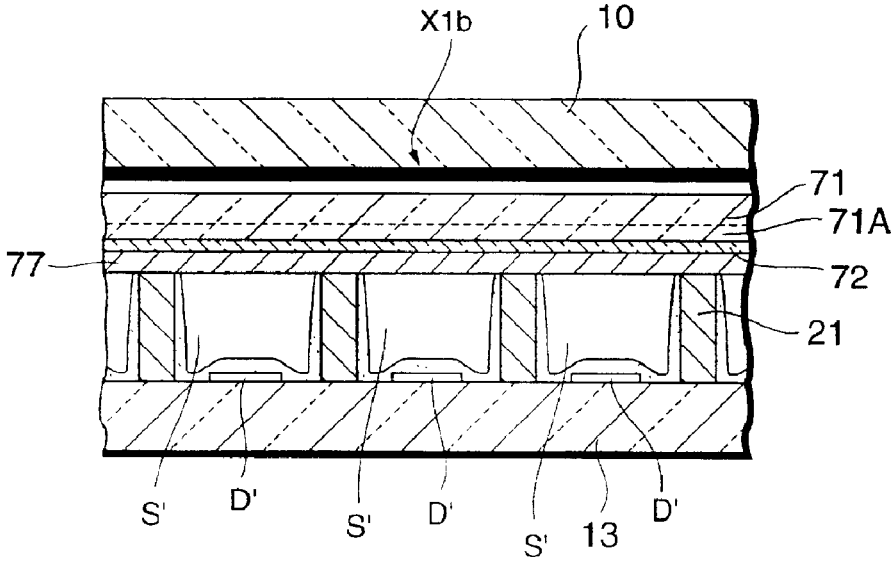
FIG. 36 is a section view taken along the W9—W9 line of FIG. 34.

Next, a seventh example in the embodiment according to the present invention will be described with reference to FIG. 34 to FIG. 36.

Figure 34:
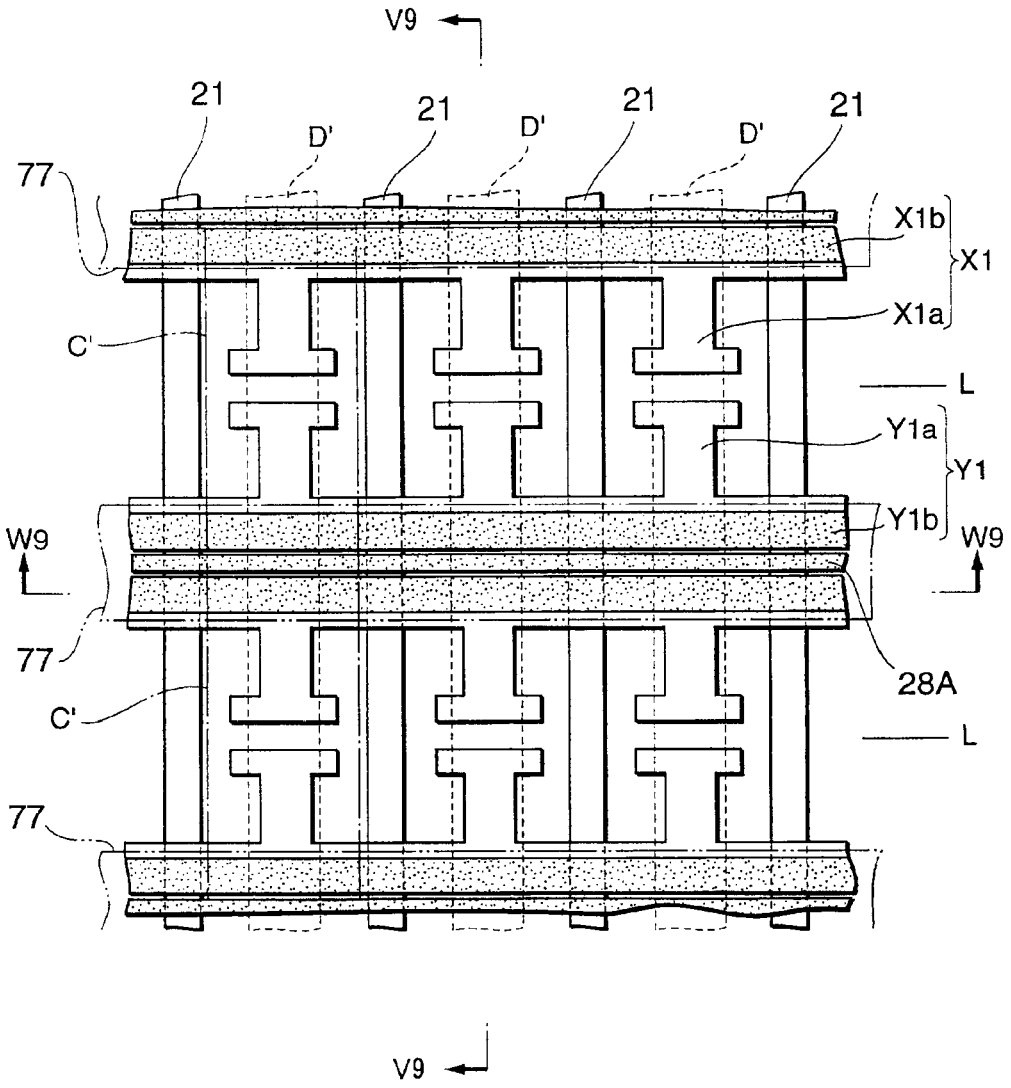
FIG. 34 is a front view schematically illustrating a seventh example according to the present invention.

FIG. 34 is a front view schematically illustrating PDP according to the seventh example. FIG. 35 is a section view taken along the V9—V9 line in FIG. 34. FIG. 36 is a section view taken along the W9—W9 line in FIG. 34.

The PDP in the sixth example is constructed such that the vertical walls and the transverse walls of the partition wall surround each discharge cell in all directions for definition. In contrast, the PDP illustrated in FIGS. 34 to 36 is constructed such that a discharge space S' between a front glass substrate 10 and a back glass substrate 13 is defined by a stripe-patterned partition wall 21 extending in the column direction as in the case of the foregoing second example.

On the back face of a dielectric layer 71, an additional dielectric layer 71A is provided opposite the back-to-back bus electrodes X1*b* and Y1*b* of the respective row electrode pairs (X1, Y1) adjacent to each other in the column direction.

Each of the bus electrodes X1*b*, Y1*b* of the respective row electrodes X1, Y1 is formed in a double-layer structure of a black conductive layer on the display surface side and a main conductive layer on the back substrate side. On the back face of the front glass substrate 10, a black light absorption layer (light-shield layer) 28A extends in the row direction along the bus electrodes X1*b*, Y1*b* between the back-to-back bus electrodes X1*b*, Y1*b* of the respective row electrode pairs (X1, Y1) adjacent to each other in the column direction.

On the back face of the protective layer 72 overlaying the additional dielectric layer 71A, a priming particle generating layer (priming particle generating member) 77 made of the ultraviolet region light emissive material or the visible region light emissive material as in each example described hereinbefore.

With the above design, in a reset discharge when an image is generated, vacuum ultraviolet rays are radiated from xenon included in a discharge gas, and excite the ultraviolet region light emissive layer 77 provided on the back face of the protective layer 72 to cause it to radiate the ultraviolet light or the visible light.

The resulting ultraviolet light or visible light excites the protective layer 72 to continue regenerating the priming particles in the discharge space of the lighted cell during the addressing period in one sub-field. Hence, a decrease of the amount of priming particles in each lighted cell is inhibited. For this reason, an extension of a discharge delay time in the subsequent addressing period is retarded and also producing of variation of the discharge delay time is suppressed.

The PDP in the seventh example does not have a partition wall for defining each discharge cell in the column direction. However, since the transparent electrodes X1*a*, Y1*a* of the respective row electrodes X1, Y1 protrude from the corresponding bus electrodes X1*b*, Y1*b* in the column direction to face each other, interference between discharges in the adjacent discharges cells C' in the column direction is suppressed.

Figure 38:
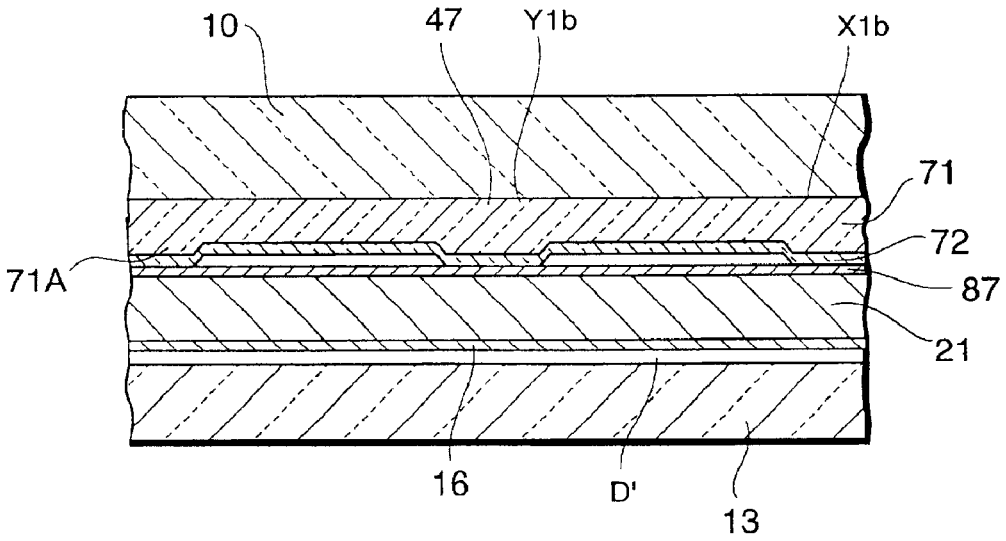
FIG. 38 is a section view taken along the V10—V10 line of FIG. 37.
Figure 39:
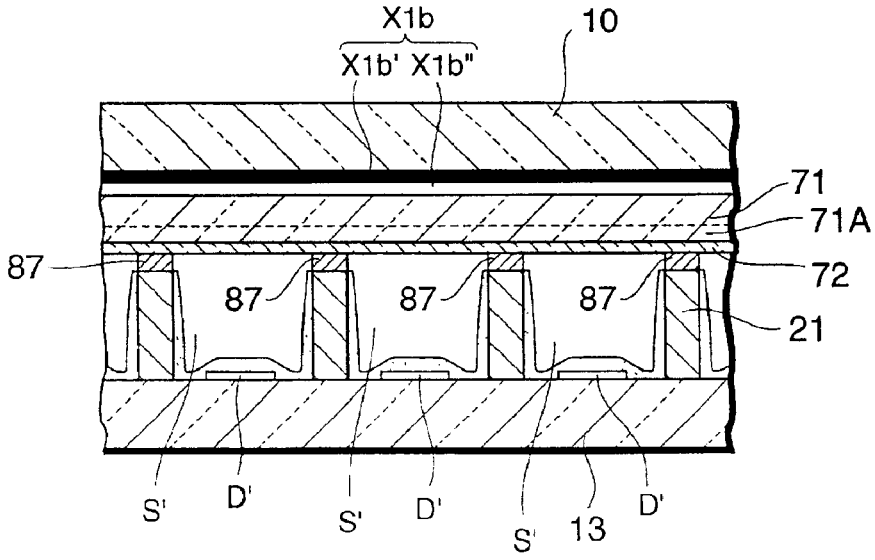
FIG. 39 is a section view taken along the W10—W10 line of FIG. 37.

Next, an eighth example in the embodiment according to the present invention will be described with reference to FIG. 37 to FIG. 39.

Figure 37:
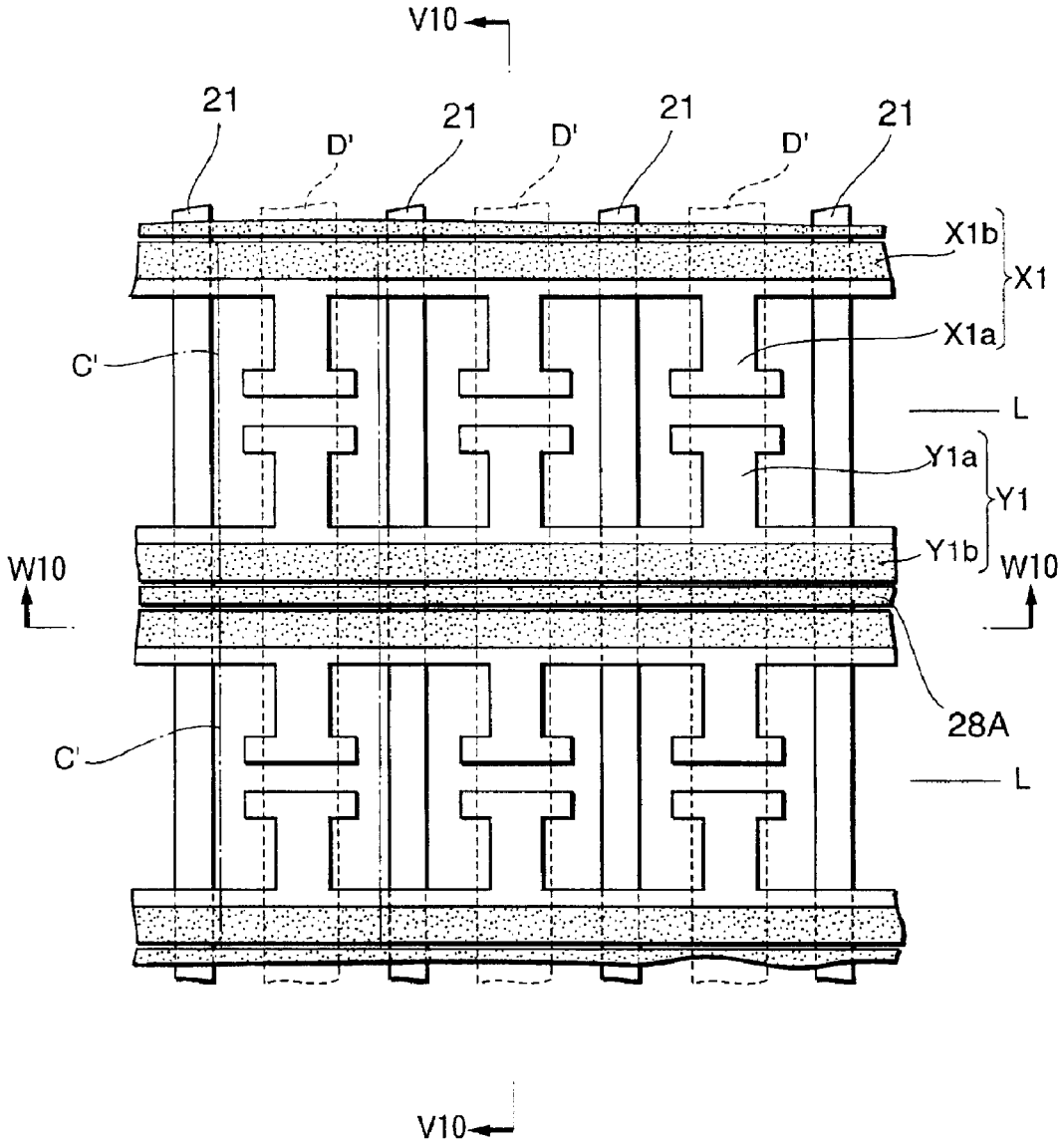
FIG. 37 is a front view schematically illustrating an eighth example according to the present invention.

FIG. 37 is a front view schematically illustrating PDP in the eighth example. FIG. 38 is a section view taken along the V10—V10 line in FIG. 37. FIG, 39 is a section view taken along the W10—W10 line in FIG. 37.

The seventh example has described on the priming particle generating layer 77 being provided on the portion of the protective layer 72 opposing the additional dielectric layer 71A. However, in the PDP illustrated in FIGS. 37 to 39, a priming particle generating layer (priming particle generating member) 87 is provided on the front face of a stripe-patterned partition wall 21 which extends in the column direction and defines a discharge space S' between a front glass substrate 10 and a back glass substrate 13.

The configuration of other components is the same as that in the PDP of the seventh example and the same reference numerals are attached.

In the PDP of the eighth example, in the reset discharge when an image is generated, vacuum ultraviolet rays radiated from xenon included in a discharge gas excite the priming particle generating layer 87 provided on the partition wall 21 to cause it to radiate ultraviolet light.

The resulting ultraviolet light continues regenerating priming particles in the discharge space of the lighted cell during the addressing period in one sub-field, to inhibit a decrease of the amount of priming particles in each lighted cell. In consequence, an extension of the discharge delay time in the subsequent addressing period is inhibited and also producing of variation of the discharge delay time is suppressed.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising;

a priming particle generating member provided at a site facing each unit light emitting area between the front substrate and the back substrate;

wherein said priming particle generating member is formed separate from said phosphor layer and is made up of an ultraviolet region light emissive layer formed of an ultraviolet region light emitting phosphor having persistence characteristics allowing continuous radiation of ultraviolet light for at least 0.1 msec as a result of excitation by ultraviolet rays having a predetermined wavelength, and wherein said ultraviolet region light emissive layer extends in the row direction at each site opposing the row electrode pairs, and faces toward the discharge space of the unit light emitting areas adjacent to each other in the column direction.

2. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection, with the row electrode pair, and a phosphor layer on a face of the back substrate facing the discharge space, said plasma display panel comprising:

a priming particle generating member provided at a site facing each unit light emitting area between the front substrate and the back substrate;

wherein said priming particle generating member is formed separate from said phosphor layer and is made up of an ultraviolet region light emissive layer formed of an ultraviolet region light emitting phosphor having persistence characteristics allowing continuous radiation of ultraviolet light for at least 0.1 msec as a result of excitation by ultraviolet rays having a predetermined wavelength, and wherein said ultraviolet region light emissive-layer extends in column direction at each site between the unit light emitting areas adjacent to each other in the row direction, and faces toward the discharge space of the unit light emitting areas adjacent to each other in the row direction.

3. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate, and a partition wall disposed between the front substrate and the back substrate, and including transverse walls extending in the row direction and vertical walls extending in the column direction to partition the discharge space into the unit light emitting areas wherein said priming particle generating member is formed separate from said phosphor layer and is made up of an ultraviolet region light emissive layer formed of an ultraviolet region light emitting phosphor having persistence characteristics allowing continuous radiation of ultraviolet light for at least 0.1 msec as a result of excitation by ultraviolet rays having a predetermined wavelength, and wherein said ultraviolet region light emissive layer is provided between the front substrate and the transverse wall of the partition wall.

4. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate, and a partition wall disposed between the front substrate and the back substrate, and including transverse walls extending in the row direction and vertical walls extending in the column direction to partition the discharge space into the unit light emitting areas;

wherein said priming particle generating member is formed separate from said phosphor layer and is made up of an ultraviolet region light emissive layer formed of an ultraviolet region light emitting phosphor having persistence characteristics allowing continuous radiation of ultraviolet light for at least 0.1 msec as a result of excitation by ultraviolet rays having a predetermined wavelength, and wherein said ultraviolet region light emissive layer is provided between the front substrate and the vertical wall of the partition wall.

5. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate, and a stripe patterned partition wall disposed between the front substrate and the back substrate and extending in the column direction to partition the discharge space into the unit light emitting areas aligned in the column direction wherein said priming particle generating member is formed separate from said phosphor layer and is made up of an ultraviolet region light emissive layer formed of an ultraviolet region light emitting phosphor having persistence characteristics allowing continuous radiation of ultraviolet light for at least 0.1 msec as a result of excitation by ultraviolet rays having a predetermined wavelength, wherein a row electrode of each of said row electrode pair includes a main body extending in the row direction and a protruding portion protruding from the main body in the column direction in each unit light emitting area, and wherein said ultraviolet region light emissive layer extends in the row direction at each position opposing the main bodies of the row electrodes.

6. The plasma display panel according to any one of claims 1 to 5, further comprising a light absorption layer provided at each position opposing a non-lighting area between the unit light emitting areas adjacent to each other in the row direction or the column direction of the front substrate, and opposite the back substrate in relation to said ultraviolet region light emissive layer.

7. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form, a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate;

wherein said priming particle generating member is made up of a secondary electron emissive layer formed of a material having a coefficient of secondary electron emission higher than that of dielectrics forming said protective dielectric layer, and wherein said phosphor layer contains the material, having a coefficient of secondary electron emission higher than that of the dielectrics forming said protective dielectric layer, to be formed in combination with said secondary electron emissive layer.

8. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate, and a dielectric layer overlaying column electrodes between the back substrate and the phosphor layer;

wherein said priming particle generating member is formed separate from said phosphor layer and is made up of a secondary electron emissive layer formed of a material having a coefficient of secondary electron emission higher than that of dielectrics forming said protective dielectric layer, and wherein said dielectric layer contains the material, having a coefficient of secondary electron emission higher than that of the dielectrics forming said protective dielectric layer, to be formed in combination with said secondary electron emissive layer.

9. The plasma display panel according to any one of claims 7 and 8, further comprising:

a partition wall provided between the front substrate and the back substrate for partitioning the discharge space into the unit light emitting areas, and wherein said secondary electron emissive layer is provided on a side wall-face of the partition wall.

10. The plasma display panel according to any one of claims 7 and 8, further comprising a partition wall disposed between the front substrate and the back substrate for partitioning the discharge space into the unit light emitting areas, and containing the material having a coefficient of secondary electron emission higher than that of the dielectrics forming said protective dielectric layer to be formed in combination with said secondary electron emissive layer.

11. The plasma display panel according to any one of claims 7 and 8, wherein said secondary electron emissive layer is placed between the back substrate and the phosphor layer.

12. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate wherein said priming particle generating member includes a secondary electron emissive layer formed of a material having a high coefficient of secondary electron emission, and, an ultraviolet region light emissive layer formed of an ultraviolet region light emitting phosphor having persistence characteristics allowing continuous radiation of ultraviolet light as a result of excitation by ultraviolet rays having a predetermined wavelength or a visible region light emissive layer formed of a visible region light emitting phosphor having persistence characteristics allowing continuous radiation of visible light as a result of excitation by ultraviolet rays having a predetermined wavelength, and wherein said ultraviolet region light emissive layer or said visible region light emissive layer contains the material having a high coefficient of secondary electron emission, to be formed in combination with said secondary electron emissive layer.

13. A plasma display panel including a front substrate and a back substrate on opposite sides of a discharge space, a plurality of row electrode pairs extending in a row direction and arranged in a column direction on the front substrate to form display lines, a protective dielectric layer provided on a face of the front substrate facing the discharge space, a plurality of column electrodes extending in the column direction and arranged in the row direction on the back substrate to form a unit light emitting area in the discharge space at each intersection with the row electrode pair, and a phosphor layer on a face of the back substrate facing the discharge space, said plasma display panel comprising:

a priming particle generating member provided at a site facing each unit light emitting area between the front substrate and the back substrate wherein said priming particle generating member includes a secondary electron emissive layer formed of a material having a high coefficient of secondary electron emission, and, an ultraviolet region light emissive layer formed of an ultraviolet region light emitting phosphor having persistence characteristics allowing continuous radiation of ultraviolet light as a result of excitation by ultraviolet rays having a predetermined wavelength or a visible region light emissive layer formed of a visible region light emitting phosphor having persistence characteristics allowing continuous radiation of visible light as a result of excitation by ultraviolet rays having a predetermined wavelength, and wherein said phosphor layer contains the ultraviolet region light emitting phosphor and the material having a high coefficient of secondary electron emission, to be formed in combination with said ultraviolet region light emissive layer and said secondary electron emissive layer.

14. The plasma display panel according to any one of claims 12 and 13, wherein said phosphor layer contains the ultraviolet region light emitting phosphor to be formed in combination with said ultraviolet region light emissive layer.

15. The plasma display panel according to any one of claims 12 and 13, wherein the ultraviolet region light emitting phosphor forming said ultraviolet region light emissive layer or the visible region light emitting phosphor forming said visible region light emissive layer is a light emissive material having persistence characteristics allowing radiation for 0.1 msec or more.

16. The plasma display panel according to any one of claims 12 and 13, wherein a light absorption layer is provided at a position opposing a non-lighting area between the unit light emitting areas adjacent to each other in the row direction or the column direction of the front substrate, and opposite the back substrate in relation to said ultraviolet region light emissive layer or said visible region light emissive layer.

17. A plasma display panel including a front substrate, a back substrate, a plurality of row electrode pairs arranged in a column direction and extending in a row direction to form display lines on a back face of the front substrate, a dielectric layer overlaying the row electrode pairs on the back face of the front substrate, a protective dielectric layer overlaying the dielectric layer on the back face of the front substrate, and a plurality of column electrodes arranged in the row direction on a face of the back substrate opposing the front substrate with a discharge space between, and extending in the column direction to form unit light emitting areas in the discharge space at each intersection of the row electrode pairs and the column electrodes, said plasma display panel comprising:

a priming particle generating member provided in contact with the discharge space between the adjacent unit light emitting areas in the column direction or the row direction;

wherein said priming particle generating member is formed of an ultraviolet region light emissive material or a visible region light emissive material having persistence characteristics allowing emission for 0.1 msec or more, and includes a material having a work function smaller than that of dielectrics forming the protective dielectric layer.

18. A plasma display panel including a front substrate, a back substrate, a plurality of row electrode pairs arranged in a column direction and extending in a row direction to form display lines on a back face of the front substrate, a dielectric layer overlaying the row electrode pairs on the back face of the front substrate, a protective dielectric layer overlaying the dielectric layer on the back face of the front substrate, and a plurality of column electrodes arranged in the row direction on a face of the back substrate opposing the front substrate with a discharge space between, and extending in the column direction to form unit light emitting areas in the discharge space at each intersection of the row electrode pairs and the column electrodes, said plasma display panel comprising:

a priming particle generating member provided in contact with the discharge space between the adjacent unit light emitting areas in the column direction or the row direction;

a partition wall disposed between the front substrate and the back substrate and including vertical walls extending in the column direction and transverse walls extending in the row direction to define the discharge space into the unit light emitting areas in the row direction and in the column direction, said transverse wall between the unit light emitting areas to each other in the column direction being divided, an interstice extending in parallel to the row direction and provided between the divided transverse walls to space the divided transverse walls from each other, and a communication element provided for communication between the interior of said interstice and the interior of the discharge spaces of the unit light emitting areas adjacent to said interstice in the column direction wherein said priming particle generating member is placed in said interstice.

19. The plasma display panel according to claim 18, further comprising an additional portion provided at a portion of the dielectric layer, opposing said transverse wall of said partition wall and said interstice, and protruding toward the transverse wall.

20. The plasma display panel according to claim 19, wherein said communication element is provided in said additional portion.

21. The plasma display panel according to claim 18, wherein said communication element is provided in said transverse wall of said partition wall.

22. The plasma display panel according to claim 18, wherein a light absorption layer is provided at a portion of the dielectric layer opposing said interstice.

23. The plasma display panel according to claim 18, wherein said transverse walls of said partition wall on the front substrate side respectively have higher parts in height than said vertical wall to form a groove between the adjacent higher parts for constructing said communication element.

24. The plasma display panel according to claim 23, wherein said priming particle generating member is disposed on at least a portion in contact with said groove and of said higher part of said transverse wall having a higher height than that of said vertical wall.

25. The plasma display panel according to claim 24, wherein said priming particle generating member is formed of an ultraviolet region light emissive material or a visible region light emissive material having persistence characteristics allowing emission for 0.1 msec or more.

26. The plasma display panel according to claim 25, wherein said priming particle generating member includes a material having a work function smaller than that of dielectrics forming the protective dielectric layer.

27. The plasma display panel according to claim 18, wherein said transverse walls of said partition wall on the front substrate side have respectively higher parts in height than said vertical wall, to form a groove between the adjacent higher parts, and said priming particle generating member is disposed in the groove.

28. The plasma display panel according to claim 27, wherein said priming particle generating member is formed of an ultraviolet region light emissive material or a visible region light emissive material having persistence characteristics allowing emission for 0.1 msec or more.

29. The plasma display panel according to claim 28, wherein the discharge space is filled with a discharge gas including a mixed inert gas containing 10% or more of a xenon gas.

30. A plasma display panel including a front substrate, a back substrate, a plurality of row electrode pairs arranged in a column direction and extending in a row direction to form display lines on a back face of the front substrate, a dielectric layer overlaying the row electrode pairs on the back face of the front substrate, a protective dielectric layer overlaying the dielectric layer on the back face of the front substrate, and a plurality of column electrodes arranged in the row direction on a face of the back substrate opposing the front substrate with a discharge space between, and extending in the column direction to form unit light emitting areas in the discharge space at each intersection of the row electrode pairs and the column electrodes, said plasma display panel comprising:

a priming particle generating member provided in contact with the discharge space between the adjacent unit light emitting areas in the column direction or the row direction;

an additional portion provided at a portion of the dielectric layer opposing the border between the unit light emitting areas adjacent to each other in the column direction, and jutting toward the interior of the discharge space;

a partition wall disposed between the front substrate and the back substrate and including vertical walls extending in the column direction and transverse walls extending in the row direction to define the discharge space into the unit light emitting areas in the row direction and in the column direction, said transverse walls being between the unit light emitting areas and being divided in the column direction, and an interstice extending in parallel to the row direction and provided between the divided transverse walls to space the divided transverse walls from each other;

wherein said priming particle generating member is formed separate from said phosphor layer and is disposed on a portion of said additional portion facing the discharge space, and wherein a light absorption layer, is provided at a portion of the dielectric layer opposing said interstice.

31. The plasma display panel according to claim 30, further comprising a light absorption layer provided at a portion of the dielectric layer opposing said priming particle generating member.

32. The plasma display panel according to any one of claims 17 to 30, wherein said priming particle generating member includes a material having a work function of 4.2 eV or less.

33. A plasma display panel including a front substrate, a back substrate, a plurality of row electrode pairs arranged in a column direction and extending in a row direction to form display lines on a back face of the front substrate, a dielectric layer overlaying the row electrode pairs on the back face of the front substrate, a protective dielectric layer overlaying the dielectric layer on the back face of the front substrate, and a plurality of column electrodes arranged in the row direction on a face of the back substrate opposing the front substrate with a discharge space between, and extending in the column direction to form unit light emitting areas in the discharge space at each intersection of the row electrode pairs and the column electrodes, said plasma display panel comprising:

a priming particle generating member provided in contact with the discharge space between the adjacent unit light emitting areas in the column direction or the row direction, and a partition wall disposed between the front substrate and the back substrate, and defining the border between the unit light emitting areas adjacent to each other at least in the row direction;

wherein said priming particle generating member is formed separate from said phosphor layer and is placed on a front face of the partition wall opposing the front substrate and faces the discharge space, and is formed of an ultraviolet region light emissive material or a visible region light emissive material having persistence characteristics allowing emission for 0.1 msec or more.

34. The plasma display panel according to claim 33, wherein said priming particle generating member includes a material having a work function smaller than that of dielectrics forming the protective dielectric layer.

35. The plasma display panel according to claim 33, wherein said priming particle generating member includes a material having a work function of 4.2 eV or less.

36. A plasma display panel including a front substrate, a back substrate, a plurality of row electrode pairs arranged in a column direction and extending in a row direction to form display lines on a back face of the front substrate, a dielectric layer overlaying the row electrode pairs on the back face of the front substrate, a protective dielectric layer overlaying the dielectric layer on the back face of the front substrate, and a plurality of column electrodes arranged in the row direction on a face of the back substrate opposing the front substrate with a discharge space between, and extending in the column direction to form unit light emitting areas in the discharge space at each intersection of the row electrode pairs and the column electrodes, said plasma display panel comprising:

a priming particle generating member provided in contact with the discharge space between the adjacent unit light emitting areas in the column direction or the row direction;

wherein said priming particle generating member is formed separate from said phosphor layer and is formed of an ultraviolet region light emissive material or a visible region light emissive material having persistence characteristics allowing emission for 0.1 msec or more, and wherein the discharge space is filled with a discharge gas including a mixed inert gas containing 10% or more of a xenon gas.

37. A plasma display panel including a front substrate, a back substrate, a plurality of row electrode pairs arranged in a column direction and extending in a row direction to form display lines on a back face of the front substrate, a dielectric layer overlaying the row electrode pairs on the back face of the front substrate, a protective dielectric layer overlaying the dielectric layer on the back face of the front substrate, and a plurality of column electrodes arranged in the row direction on a face of the back substrate opposing the front substrate with a discharge space between, and extending in the column direction to form unit light emitting areas in the discharge space at each intersection of the row electrode pairs and the column electrodes, said plasma display panel comprising:

a priming particle generating member provided in contact with the discharge space between the adjacent unit light emitting areas in the column direction or the row direction;

wherein said priming particle generating member is formed of an ultraviolet region light emissive material or a visible region light emissive material having persistence characteristics allowing emission for 0.1 msec or more, and includes a material having a work function of 4.2 eV or less.

* * * * *